US009291988B2

(12) United States Patent
Tenjiku et al.

(10) Patent No.: US 9,291,988 B2
(45) Date of Patent: Mar. 22, 2016

(54) IMAGE FORMING APPARATUS INCLUDING CARTRIDGE POSITION DETECTOR

(71) Applicant: Sharp Kabushiki Kaisha, Osaka (JP)

(72) Inventors: Eiji Tenjiku, Osaka (JP); Yasuyuki Ishiguro, Osaka (JP); Hisashi Kunihiro, Osaka (JP); Hitoshi Nagahama, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/243,121

(22) Filed: Apr. 2, 2014

(65) Prior Publication Data

US 2014/0301744 A1 Oct. 9, 2014

(30) Foreign Application Priority Data

Apr. 3, 2013 (JP) ..... 2013-077533
Apr. 3, 2013 (JP) ..... 2013-077559

(51) Int. Cl.
*G03G 15/00* (2006.01)
*G03G 21/16* (2006.01)
*G03G 21/18* (2006.01)

(52) U.S. Cl.
CPC ..... *G03G 21/1623* (2013.01); *G03G 21/1842* (2013.01)

(58) Field of Classification Search
CPC ..... G03G 21/1623; G03G 21/1842
USPC ..... 399/13
See application file for complete search history.

(56) References Cited

U.S. PATENT DOCUMENTS 5,182,595 A * 1/1993 Fukuchi ..... G03G 21/1864 271/162
2005/0105721 A1* 5/2005 Ono ..... G03G 15/50 380/51
2008/0317478 A1* 12/2008 Suda ..... G03G 15/55 399/10
2009/0324260 A1* 12/2009 Andou ..... G03G 15/50 399/13
2010/0028026 A1* 2/2010 Inami ..... G03G 15/081 399/12
2014/0118459 A1* 5/2014 Takada ..... G06K 15/1209 347/247

FOREIGN PATENT DOCUMENTS

JP 2008-180814 8/2008
JP 2008-216331 9/2008
JP 2011-186194 9/2011

* cited by examiner

*Primary Examiner* — Francis Gray
(74) *Attorney, Agent, or Firm* — Keating & Bennett, LLP

(57) ABSTRACT

An image forming apparatus to which a plurality of process cartridges has a safety switch for detecting opening and closing of a front cover, stroke switches for detecting positions of the process cartridges, a display portion and a speaker for notifying a state of the process cartridge, and a control portion. The control portion has a cartridge information notifying function for, when closing of the front cover is detected by the safety switch and the process cartridge is not detected by the stroke switch, notifying information of the process cartridge. Further, the control portion has a cartridge information notifying function for notifying first notification information for replacing the process cartridge, a cartridge moving function for moving the process cartridge by a moving portion, and a cartridge information notification cancelling function for cancelling notification of the first notification information.

9 Claims, 17 Drawing Sheets

100B
110B
150B
160
130
131
132
140
P
S

IMAGE FORMING APPARATUS INCLUDING CARTRIDGE POSITION DETECTOR

This Nonprovisional application claims priority under 35 U.S.C. §119(a) on Patent Application No. 2013-77533 filed in Japan on 3 Apr. 2013 and Patent Application No. 2013-77559 filed in Japan on 3 Apr. 2013, the entire contents of which are hereby incorporated by reference.

BACKGROUND OF THE INVENTION (1) Field of the Invention

The present invention relates to an image forming apparatus, and particularly, to an image forming apparatus configured so that a plurality of process cartridges are attachably and detachably disposed to an apparatus main body.

(2) Description of the Prior Art

In recent years, an image forming apparatus such as a laser printer is configured so that a toner cartridge (process cartridge) is attached so as to be attachably and detachably disposed and toners (recording material) stored in the toner cartridge are used to form an image on a recording medium such as printing paper.

As a prior art, for example, patent document 1 described below discloses a configuration of an image forming apparatus that has, as shown in FIG. 1, an attachment portion to which each of a plurality of cartridges 7*a*, 7*b*, 7*c* and 7*d* is attached so as to be detachable, an opening and closing member 121 which rotates to open and close the attachment portion, a plurality of urged portions 71*a*, 71*b*, 71*c* and 71*d* corresponding to the plurality of cartridges 7*a*, 7*b*, 7*c* and 7*d*, respectively, and a plurality of urging portions 31*a*, 31*b*, 31*c* and 31*d* provided in the opening and closing member 121, in which, in case of closing the opening and closing member 121, each of the plurality of urging portions 31*a*, 31*b*, 31*c* and 31*d* urges each of the plurality of urged portions 71*a*, 71*b*, 71*c* and 71*d* correspondingly.

Moreover, patent document 1 discloses a configuration in which, as shown in FIG. 2, an interval between the plurality of urging portions 31*a*, 31*b*, 31*c* and 31*d* and each of corresponding shutter members 105*a*, 105*b*, 105*c* and 105*d* is changed respectively so that timings of peaks of reaction forces from the plurality of shutter members 105*a*, 105*b*, 105*c* and 105*d* to the plurality of urging portions 31*a*, 31*b*, 33*c* and 31*d*, which are caused when closing the opening and closing member 121, are shifted from each other.

This makes it possible to provide an image forming apparatus which is convenient to use by reducing a force required in closing the opening and closing member 121 and improving the operability of the opening and closing member 121.

Further, patent document 1 discloses a configuration in which, as shown in FIG. 3A and FIG. 3B, in case of closing the opening and closing member 121, a fixing member (urging member) 106 is pressed by the urging portion 31*a* to operate to fix the cartridge 7*a* by the fixing member 106.

Moreover, as another prior art, it is disclosed that, in an image forming apparatus, a reading portion capable of reading identification information (non-contact IC tag) is provided for each attachment portion to which a cartridge is attached, whether or not the identification information read by the reading portion corresponds to the attachment portion of the cartridge is judged, and indicating is performed in the case of a judgment result of being not corresponding, as well as a method of indicating performed by a indicating portion is by dial tone, voice, display on a display device, or a free combination combined by those three (see patent document 2 described below).

This makes it possible to suppress a cartridge from being incorrectly attached carelessly without changing the physical shape for each color.

Further, as another prior art, it is disclosed that, in an image forming apparatus, control is performed so that, when a recording material cartridge attached to a cartridge attachment portion is drawn, a cover is opened by cover opening and closing driving means to move the recording material cartridge in the drawing direction by cartridge driving means, control is performed so that, when the recording material cartridge is attached to the cartridge attachment portion, the recording material cartridge is moved by the cartridge driving means to the direction opposite to the drawing direction until it is attached to the cartridge attachment portion to close the cover by the cover opening and closing driving means, and instruction receiving means for receiving operation input of an instruction to move the recording material cartridge is included (see patent document 3 described below).

This makes it possible to simplify replacement working of the recording material cartridge.

PRIOR ART LITERATURES

Patent Documents

Patent document 1: Japanese Patent Application Laid-open No. 2008-216331

Patent document 2: Japanese Patent Application Laid-open No. 2008-180814

Patent Literature 3: Japanese Patent Application Laid-open No. 2011-186194

However, in the system described in patent document 1, for example, in a case where a cartridge in which a foreign object is adhered to a coupling portion is inserted into the apparatus, even when the image forming apparatus is driven, an axis of a driving gear on the side of the cartridge and an axis of a driving gear on the side of a main body of the image forming apparatus are deviated, so that there is a risk that cracking and breakage of each driving gear is caused to damage a photosensitive member and/or an intermediate transfer belt by fragments of the driving gears.

Moreover, in the system of patent document 2, since identification information (non-contact IC tag) is used, effects of electromagnetic wave noise are not able to be ignored, so that there is a risk that the image forming apparatus operates incorrectly.

Further, in the system of Patent Literature 3, whether or not the cartridge is moved to an attachment position is judged by detecting a rotational angle of a servomotor which drives a gear engaged with the cartridge, or the attachment position of the cartridge is detected by providing a position sensor for detecting the attachment position of the cartridge in a toner box. However, with control of the rotational angle of the servomotor in patent document 3, it is impossible to accurately control clearance of engaging of the gears with the order of several mm or less, so that there is a risk that the cartridge is pushed into more than necessary to damage a driving gear of the cartridge.

Note that, in patent document 3, it is described that the position sensor for detecting the attachment position of the cartridge is provided in the toner box, but a specific configuration is not disclosed, thus being unclear, and position detection of the cartridge with the order of several mm or less is not considered.

Furthermore, in the system of patent document 1, since a lower end on the right side of a front of a cartridge housing is urged, the urging force is difficult to be transferred to the whole of the cartridge housing, so that there is a risk of bringing a cantilever state. Moreover, since the urging portions 31*a* to 31*d* are arranged in the opening and closing member 121, when a frequency of replacing the cartridges is increased, troubles are assumed such as that the opening and closing member 121 is warped and rattling becomes large so that the urging portions 31*a* to 31*d* are not able to urge the shutter members 105*a* to 105*d*.

SUMMARY OF THE INVENTION

The present invention has been devised in view of the conventional problems as described above, and aims to provide an image forming apparatus, in the case of attaching a cartridge to the image forming apparatus, capable of confirming that the cartridge is contained in a normal state without an incorrect operation and preventing breakage of a driving gear and the like due to abnormal attachment of the cartridge.

Further, the present invention aims to provide an image forming apparatus that, in the case of attaching a cartridge to the image forming apparatus, prevents erroneous replacement of the cartridges by clarifying the cartridges to be replaced as well as contains the cartridge automatically in a normal state, thus making it possible to prevent breakage of a driving gear and the like due to abnormal attachment of the cartridge and realize the stable attaching and detaching operability of the cartridge over a long period of time.

The image forming apparatus according to the present invention for solving the problems described above is as follows.

A first aspect of the present invention is an image forming apparatus for forming an image on a recording medium by using a recording material contained in a cartridge, that includes a plurality of cartridges; an attachment portion configured to contain the plurality of cartridges, each cartridge being disposed attachably and detachably; an opening and closing member, provided so as to be rotatable with respect to an apparatus main body, configured to open and close the attachment portion; a moving portion configured to move the cartridge to an image formation position in conjunction with an action of closing the opening and closing member; a control portion configured to control an action of each portion; a first detecting portion configured to detect the opening and closing member (for example, detecting an opened or closed state of the opening and closing member); a second detecting portion configured to detect presence and absence of the cartridge; and a notifying portion configured to notify a user of a state of the cartridge, and is characterized in that the control portion is provided with a function for, when it is detected by the first detecting portion that the opening and closing member is closed and the cartridge is not detected by the second detecting portion, notifying the notifying portion of information of the cartridge.

Further, a second aspect of the present invention is characterized in that the control portion is provided with a function for, when it is detected by the first detecting portion that the opening and closing member is closed and the cartridge is not detected by the second detecting portion, not allowing driving of the image forming apparatus.

Further, a third aspect of the present invention is characterized in that the control portion is provided with a function for, when it is detected by the first detecting portion that the opening and closing member is closed and the cartridge is detected by the second detecting portion, allowing driving of the image forming apparatus.

Further, a fourth aspect of the present invention is characterized in that the first detecting portion is a safety switch of the image forming apparatus, and the second detecting portion is a detecting portion (stroke switch) for detecting a position of the cartridge.

Further, a fifth aspect of the present invention is characterized in that the cartridge includes at least any one of a toner container, a photoreceptor, a charging device, and a developing device.

Further, a sixth aspect of the present invention is characterized in that the notifying portion is comprised by having at least any one of a display portion, a voice transmitting portion and an alarm transmitting portion.

Further, a seventh aspect of the present invention is characterized in that the cartridges are provided by a plurality of pieces and the plurality of cartridges are arranged in an oblique direction with respect to a horizontal direction of the image forming apparatus.

Further, an eighth aspect of the present invention is an image forming apparatus for forming an image on a recording medium using a recording material contained in a cartridge, that includes a plurality of cartridges; an attachment portion configured to contain the plurality of cartridges, each cartridge being disposed attachably and detachably; an opening and closing member configured to open and close the attachment portion; a moving portion configured to movie the cartridge; a control portion configured to control an action of each portion; a first detecting portion configured to detect the opening and closing member (for example, detecting an opened or closed state of the opening and closing member); a second detecting portion configured to detect presence and absence of the cartridge; and a notifying portion configured to notify a user of a state of the cartridge, and is characterized in that the control portion is provided with a function for notifying the notifying portion of first notification information showing necessity of replacing the cartridge (cartridge information notifying function), a function for, when it is detected by the first detecting portion that the opening and closing member is opened, moving the cartridge from an image formation position to an outside of the image forming apparatus (outer side) by the moving portion (cartridge moving function), a function for, when it is detected by the first detecting portion that the opening and closing member is closed, moving the cartridge from the outside of the image forming apparatus to the image formation position by the moving portion (cartridge moving function), and a function for, when it is detected by the second detecting portion that the moving portion moves the cartridge from the outside of the image forming apparatus to the image formation position, cancelling notification of the first notification information (cartridge information notification cancelling function).

Further, a ninth aspect of the present invention is characterized in that the control portion is provided with a function for, when it is detected by the second detecting portion that the moving portion moves the cartridge from the outside of the image forming apparatus to the image formation position, notifying the notifying portion of second notification information for informing that the cartridge is arranged at an appropriate image formation position, and thereafter cancelling notification of the first notification information.

Further, a tenth aspect of the present invention is characterized in that the first notification information includes a selection area (icon) that is selectable by a user.

Further, an eleventh aspect of the present invention is characterized in that the moving portion is provided with a movement suppressing portion (torque limiter).

Further, a twelfth aspect of the present invention is characterized in that the cartridge includes at least any one of a toner container, a photoreceptor, a charging device, and a developing device.

Further, a thirteenth aspect of the present invention is characterized in that the moving portion has a support portion for supporting at least the cartridge.

Further, a fourteenth aspect of the present invention is characterized in that the cartridges are provided by a plurality of pieces and the plurality of cartridges are arranged in an oblique direction with respect to a horizontal direction of the image forming apparatus.

According to the first to seventh aspects, it is possible, in the case of attaching the cartridge to the image forming apparatus, to confirm that the cartridge is contained in a normal state without an incorrect operation. Therefore, it is possible to prevent that, for example, the cartridge to which a foreign object is adhered without user's knowing, is inserted in the image forming apparatus as it is, so that, due to abnormal attachment of the cartridge, a driving gear and the like are broken or an intermediate transfer belt, a photosensitive member and the like are damaged by the foreign object. Further, by informing the user that the cartridge is forgotten to be attached, it is possible to perform working of replacing the cartridges reliably.

According to eighth to fourteenth aspects, the cartridge to be replaced is made clear when attaching the cartridge to the image forming apparatus. Therefore, it is possible to prevent the cartridge from being replaced erroneously, as well as since the replaced cartridge is automatically guided to the appropriate image formation position, it is possible to obtain the image forming apparatus capable of preventing damage of a driving gear and the like due to abnormal attachment of the cartridge to realize the stable attaching and detaching operability of the cartridge over a long period of time.

DESCRIPTION OF THE PREFERRED EMBODIMENTS

Description will be hereinafter given for modes for carrying out an image forming apparatus of the present invention with reference to drawings.

Figure 1:
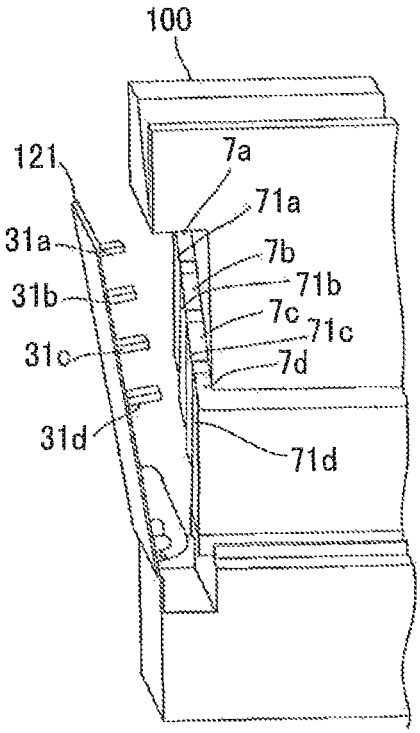
FIG. 1 is an explanatory view showing an example of a configuration of a front cover and a cartridge attachment portion of a conventional image forming apparatus.
Figure 2:
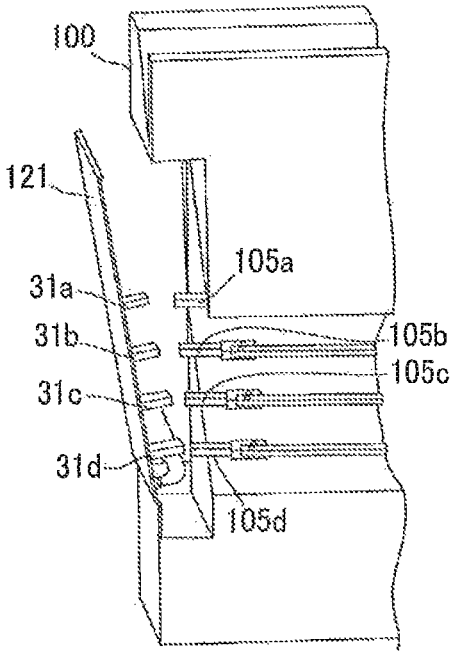
PRIOR ART FIG.2 PRIOR ART
FIG. 2 is an explanatory view showing a modification example of the configuration of the front cover and the cartridge attachment portion of the conventional image forming apparatus.
Figure 3A:
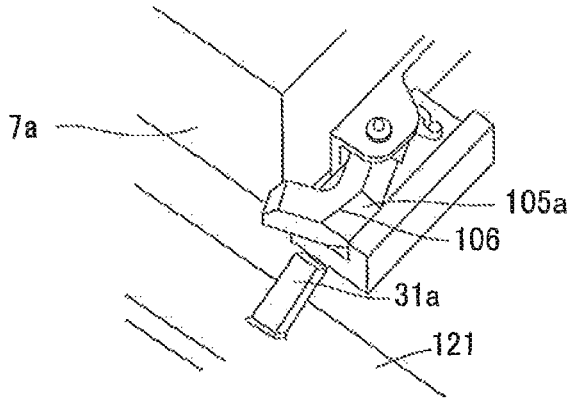
FIG.3A PRIOR ART
FIG. 3A is an explanatory view showing an example of a state where a cartridge is attached to the cartridge attachment portion of the conventional image forming apparatus and FIG. 3B is an explanatory view showing an example that the cartridge is fixed to the cartridge attachment portion.
Figure 3B:
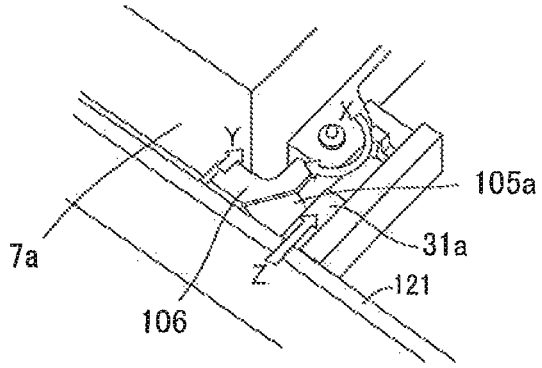
FIG.3B PRIOR ART
Figure 4:
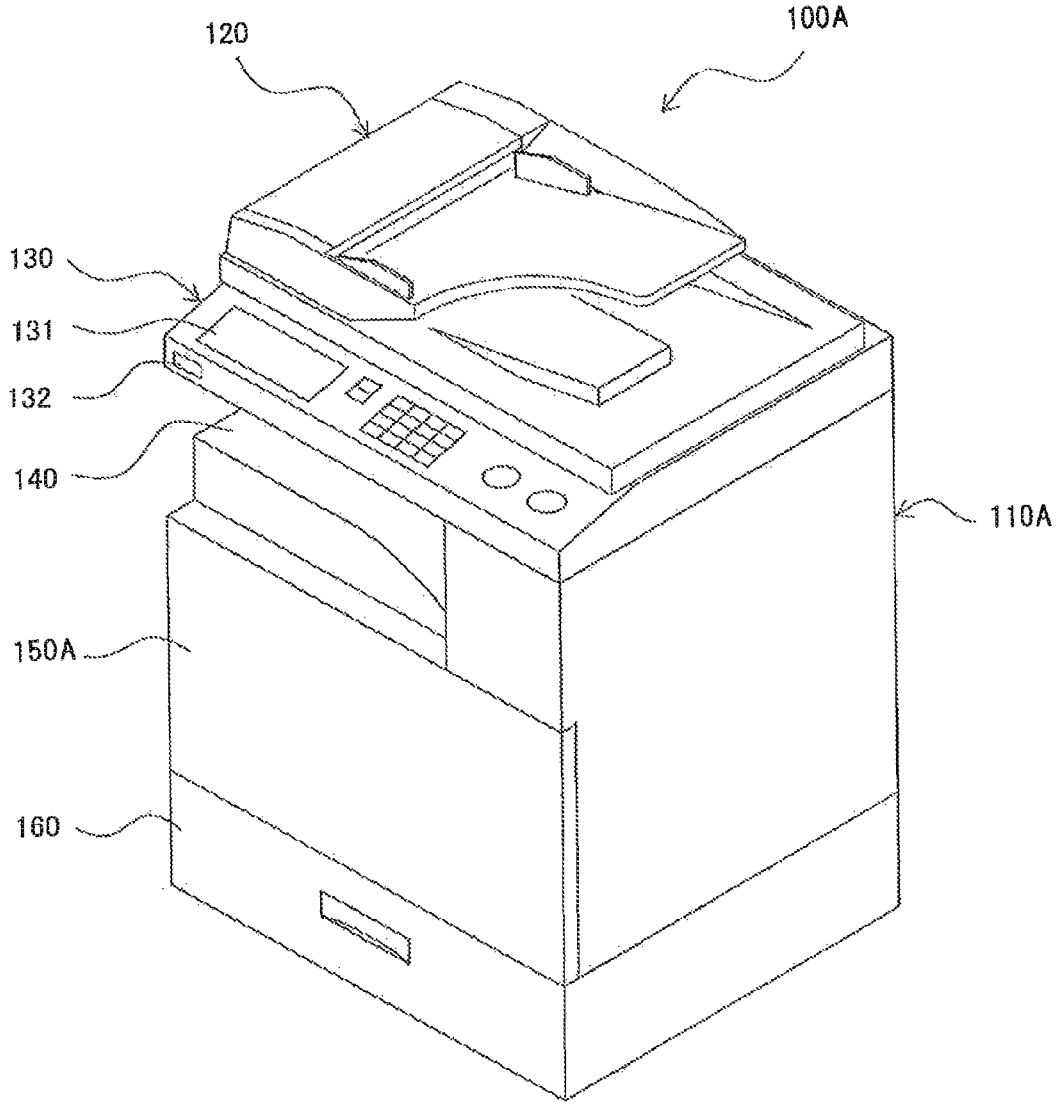
FIG. 4 is an explanatory view showing a whole configuration of an image forming apparatus according to a first embodiment of the present invention.
Figure 5B:
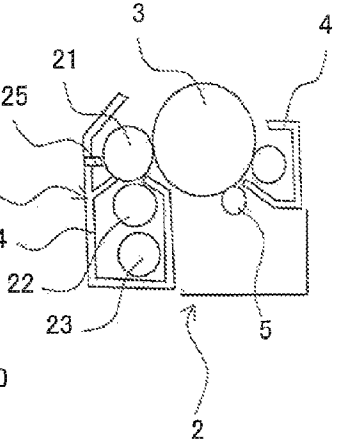
FIG. 5A is an explanatory view showing a configuration of a main part of the image forming apparatus and FIG. 5B is an explanatory view of a process cartridge used for the image forming apparatus.
Figure 5A:
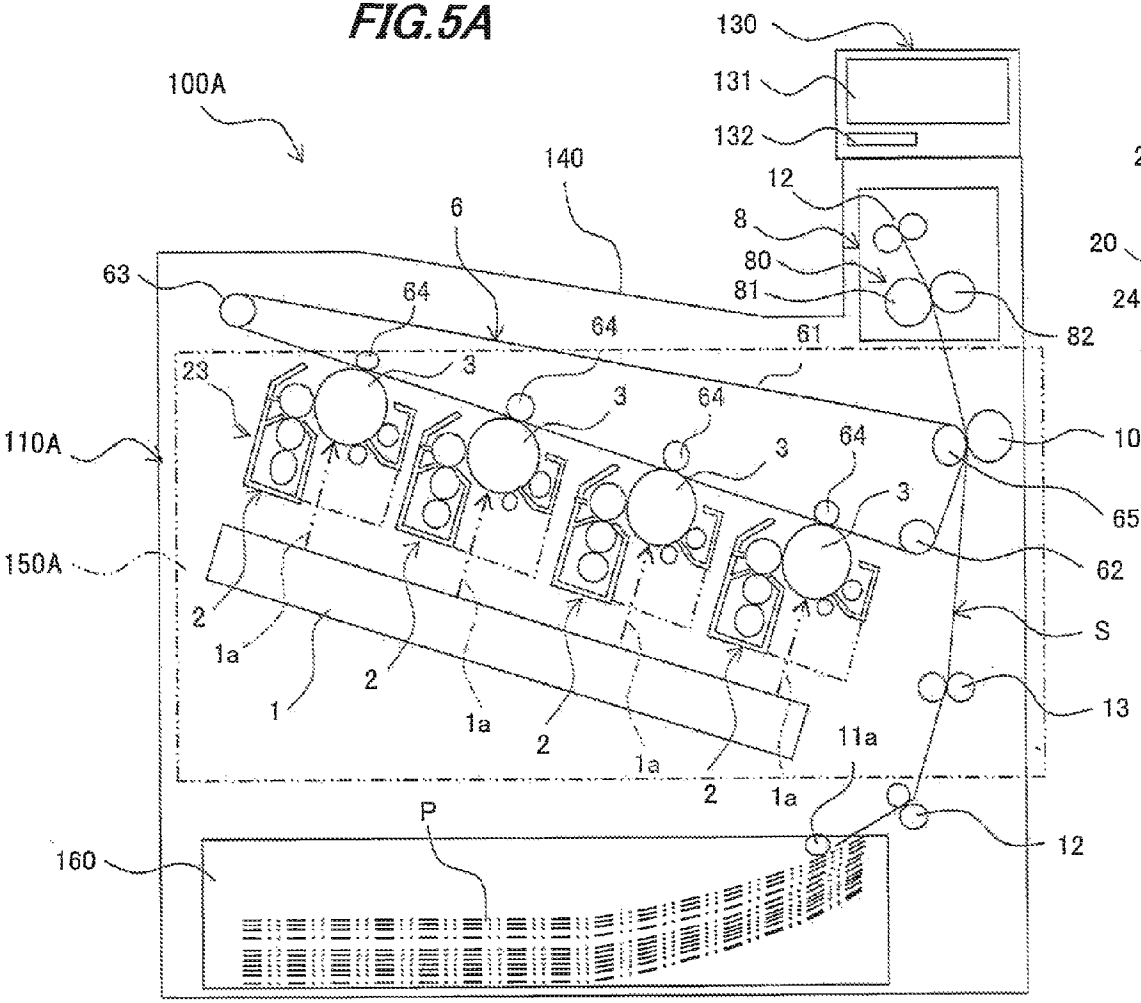

FIG. 4 is an explanatory view showing a whole configuration of an image forming apparatus according to a first embodiment of the present invention, which is an example of modes for carrying out the invention, FIG. 5A is an explanatory view showing a configuration of a main part of the image forming apparatus, and FIG. 5B is an explanatory view of a process cartridge used for the image forming apparatus.

An image forming apparatus 100A according to this first embodiment is provided with, as shown in FIG. 4 and FIG. 5A, a plurality of process cartridges (cartridges) 2, an attachment portion 111 (see FIG. 6) for attaching each of the plurality of process cartridges 2 so as to be attachably and detachably disposed, a front cover (opening and closing member) 150A which is provided so as to be rotatable with respect to an apparatus main body 110A for opening and closing the attachment portion 111, a moving portion 170A (FIG. 6) for moving the process cartridges 2 to an image formation position in conjunction with an action of closing the front cover 150A, and a control portion 201A (FIG. 8) for controlling an action of each portion, and forms an image on a recording medium (for example, sheet P) using recording material (for example, toner) contained in the process cartridges 2.

First, description will be given for a whole configuration of the image forming apparatus 100A.

In the following description, same reference numerals are assigned to the same parts. Names and functions thereof are also the same. Accordingly, detailed description thereof will not be repeated.

As shown in FIG. 4, the image forming apparatus 100A forms a multicolor image and a monocolor image on a predetermined sheet P (for example, recording paper) according to image data transmitted from the outside of the image forming apparatus 100A, and is comprised of the apparatus main body 110A and an automatic document feeder (ADF) 120.

On an upper part of the operation side of the apparatus main body 110A, an operation panel 130 is provided.

The operation panel 130 is provided with a display portion 131 and a speaker (notifying portion) 132.

As the display portion 131, a display device such as a liquid crystal display device (LCD) with a backlight, an organic ELD (Electro Luminescence Display), a display such as electronic paper using electrophoresis, a plasma display (PDP), a plasma tube array display (PTAD), or a display using an electron emitting element (FED, SED) is usable. The display portion 131 displays a screen including an instruction menu such as a setting screen to a user and information concerning obtained image data.

A paper output tray 140 is configured below the operation panel 130.

At a center part with respect to a height direction of the apparatus main body 110A on the operation side of the apparatus main body 110A (the side in which the display portion 131 is arranged), the front cover (opening and closing member) 150A for opening and closing an attachment portion inside the apparatus to which a cartridge is attached is provided. In a lower part of the apparatus main body 110A, a paper feed cassette (recording medium container) 160 is provided.

That is, as shown in FIG. 5A, the apparatus main body 110A is comprised of the plurality of process cartridges 2, an exposure unit 1, a transfer portion 6, a fixing unit 8, the paper output tray 140, the paper feed cassette 160 and the like. Each process cartridge 2 has a photosensitive member drum 3, a cleaner unit 4 and a charging roller 5.

A reference numeral 1*a* in the figure denotes an exposure light path.

On an upper part of the apparatus main body 110A, the automatic document feeder 120 is disposed (FIG. 4).

The automatic document feeder 120 conveys a document automatically onto a not-shown platen glass on the top of the apparatus main body 110A.

Image data which the image forming apparatus 100A deals with corresponds to a color image using each color of black (B), cyan (C), magenta (M), and yellow (Y).

Accordingly, four process cartridges 2 are provided so that four kinds of latent images corresponding to each color are developed. That is, the process cartridge 2 for black, the process cartridge 2 for cyan, the process cartridge 2 for magenta, and the process cartridge 2 for yellow are provided one for each image station respectively, which constitute four image stations.

Moreover, development may be formed with six colors by providing six image stations, for example, by adding process cartridges for light cyan (LC) and light magenta (LM) which have the property of the same color phase as the cyan (C) and magenta (M) and a lower density than the cyan (C) and magenta (M), in addition to black (B), cyan (C), magenta (M), and yellow (Y).

These six colors make it possible to obtain a high-quality full color image which is more vivid.

As shown in FIG. 5A, the four process cartridges 2 are arranged in parallel with a predetermined interval with respect to a travelling direction of an intermediate transfer belt 61, which are provided so that the process cartridges 2 on one side with respect to the traveling direction become higher and the process cartridges 2 on the other side become lower. That is, they are arranged in parallel and in an oblique direction with respect to a horizontal direction of the image forming apparatus 100A (so that the process cartridges 2 on the left side become higher and the process cartridges 2 on the right side become lower in FIG. 5A).

The charging roller 5 (FIG. 5B) is charging means for uniformly charging a surface of the photosensitive member drum 3 at a predetermined potential.

The exposure unit 1 (FIG. 5A) is an image writing device which exposes the charged photosensitive member drum 3 according to image data input from outside or image data obtained by reading a document to thereby form an electrostatic latent image according to the image data on the surface of the photosensitive member drum 3. In the exposure unit 1, a polygon mirror for scanning laser beams, and optical elements such as lens and mirrors for guiding laser beams reflected by the polygon mirror to the photosensitive member drum 3 are arranged.

The process cartridge 2 includes, as shown in FIG. 5B, the photosensitive member drum 3, the cleaner unit 4, the charging roller 5 and the developing device 20, and visualizes the electrostatic latent images formed on each of the photosensitive member drums 3 with toners of four colors (Y, M, C, B).

The developing device 20 has a developing roller 21, a first toner conveying roller 22, a second toner conveying roller 23, a developing tank 24 and a doctor blade 25.

As to toner supply to the developing roller 21, by frictional charging between the second toner conveying roller 23 and toners, the toners are adhered to a surface of the second toner conveying roller 23, by the frictional charging, the toners on the surface of the second toner conveying roller 23 are adhered to a surface of the first toner conveying roller 22, and the toners on the surface of the first toner conveying roller 22 are finally regulated to have appropriate toner layer thickness by the doctor blade 25 and supplied to a surface of the developing roller 21 by the frictional charging.

In the present embodiment, the second toner conveying roller 23 has a roller shape, but the shape is not limited thereto, if it is the shape capable of scraping the toners accumulated in a bottom part of the developing tank 24 to supply to the surface of the first toner conveying roller 22.

Moreover, a developer used for the image forming apparatus 100 of the present embodiment may be a dual-component developer in which toners and carriers are mixed.

The photosensitive member drum 3 has a cylindrical form and is disposed over the exposure unit 1 (see FIG. 5A), the surface thereof is cleaned by the cleaner unit 4, and the cleaned surface is uniformly charged by the charging roller 5.

The cleaner unit 4 removes and collects toners remained on the surface of the photosensitive member drum 3 after development and image transfer.

The transfer portion 6 that is arranged above the photosensitive member drum 3 (see FIG. 5A) is comprised of the endless intermediate transfer belt (endless belt) 61, an intermediate transfer belt driving roller 62, an intermediate transfer belt driven roller 63, intermediate transfer rollers 64 and an intermediate transfer belt support roller 65. Four intermediate transfer rollers 64 are provided corresponding to each color of Y, M, C and B.

The intermediate transfer belt 61 is configured so as to be stretched out and rotationally driven by the intermediate transfer belt driving roller 62, the intermediate transfer belt driven roller 63, the intermediate transfer rollers 64 and the intermediate transfer belt support roller 65.

The intermediate transfer belt 61 is formed into an endless shape using a film with thickness of about 100 μm to 150 μm, and is provided so as to be in contact with each photosensitive member drum 3 of the four process cartridges 2. Then, by sequentially superimposing and transferring, on the intermediate transfer belt 61, toner images in respective colors that are formed on the photosensitive member drums 3, a color toner image (multicolor toner image) is formed on the intermediate transfer belt 61.

The intermediate transfer roller 64 is a roller whose surface is covered with a conductive elastic material (for example, EPDM (ethylene propylene diene rubber), urethane foam or the like), and transfer bias for transferring a toner image on the photosensitive member drum 3 onto the intermediate transfer belt 61 is applied to the intermediate transfer belt 61. Specifically, to the intermediate transfer roller 64, high-voltage transfer bias (high voltage with polarity (+) opposite to charging polarity (−) of toners) is applied in order to transfer the toner image.

As described above, the toner images visualized corresponding to each color phase on each of the photosensitive member drums 3 are laminated on the intermediate transfer belt 61. The toner image as information of the laminated image is conveyed with the intermediate transfer belt 61, moved to a contact position of a sheet P to be conveyed and the intermediate transfer belt 61 (secondary transfer position, predetermined position) and transferred onto the sheet P by a transfer roller 10 arranged at this contact position.

The paper feed cassette 160 (FIG. 5A) is a tray for stacking the sheet P to be used for image formation and is provided under the exposure unit 1 of the apparatus main body 110A.

The paper output tray 140 for collecting the printed sheet P so that a printed side faces downward (facedown), is provided in the upper part of the apparatus main body 110.

Further, provided in the apparatus main body 110A is a paper feed path S that extends in an approximately vertical direction to convey the sheet P of the paper feed cassette 160 to the paper output tray 140 by way of the transfer roller 10 and the fixing unit 8. A pickup roller 11*a*, a plurality of feed rollers 12, a registration roller 13, the transfer roller 10, the fixing unit 8 and the like are arranged in the vicinity of the paper feed path S from the paper feed cassette 160 to the paper output tray 140. Note that, only a pair of the feed rollers 12 is illustrated in FIG. 5A.

The feed rollers 12 are small rollers for promoting and assisting conveyance of the sheet P and are arranged along the paper feed path S.

The pickup roller 11*a* is provided in the vicinity of an end part of the paper feed cassette 160 so as to pick up the sheet P one by one from the paper feed cassette 160 to supply to the paper feed path S.

The registration roller 13 temporarily suspends the sheet P that is being conveyed along the paper feed path S. Thus, the registration roller has a function for conveying the sheet P to the transfer roller 10 at such a timing that a front end of the sheet P will meet a front end of an image data area (including a toner image formation area) on the intermediate transfer belt 61.

The fixing unit 8 is comprised of a pair of a heat roller 81 and a pressing roller 82 as fixing rollers 80, and the heat roller 81 and the pressing roller 82 rotate and convey the sheet P so as to sandwich therebetween.

The heat roller 81 and the pressing roller 82 are arranged facing to each other, forming a fixing nip portion at the position where the heat roller 81 and the pressing roller 82 are put in press-contact with each other.

The heat roller 81 is temperature-controlled by the control portion 201A (FIG. 8) so as to be at a predetermined fixing temperature. This control portion 201A performs control so that the surface temperature of the heat roller 81 falls within a range of 160 to 200° C. based on the detected signal from a not-shown temperature detector (non-contact type thermistor) provided around the heat roller 81.

Moreover, the heat roller 81 has a function for thermally pressing the toners to the sheet P in cooperation with the pressing roller 82 so as to thermally fix the multi-color toner image transferred onto the sheet P, to the sheet P, by fusing, mixing and pressing.

On the other hand, similarly to the heat roller 81, the pressing roller 82 is also configured by having an elastic layer formed on a peripheral surface of a cylindrical metal core. The pressing roller 82 abuts against the heat roller 81 with a predetermined pressure.

In addition, the image forming apparatus 100A is connected to a PC, a FAX and a data management server of a manufacturer, a sale destination, a lease destination or the like via a not-shown network line (LAN, telephone line or the like).

Figure 6:
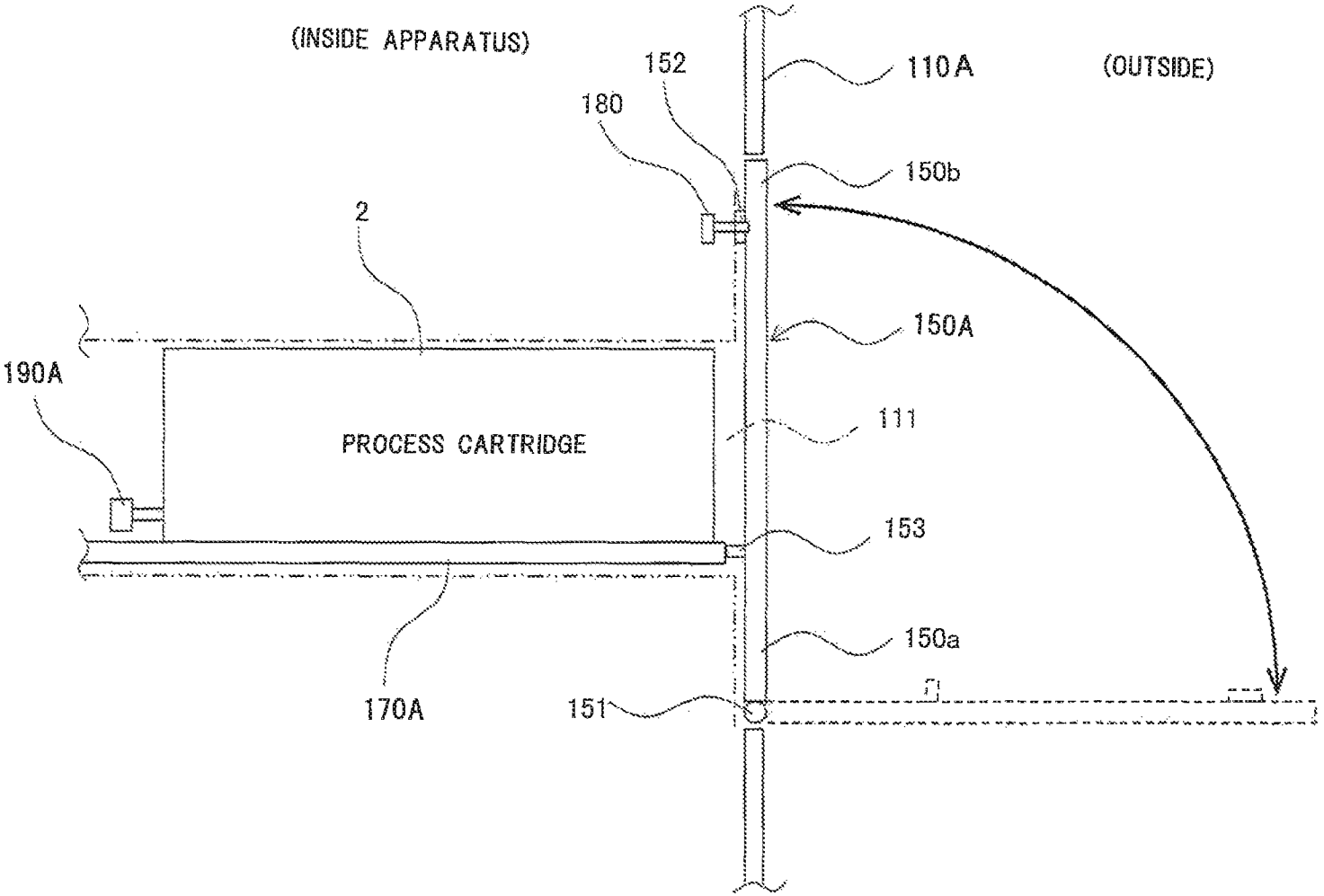
FIG. 6 is an explanatory view showing a configuration of a cartridge attachment portion of the image forming apparatus.
Figure 7B:
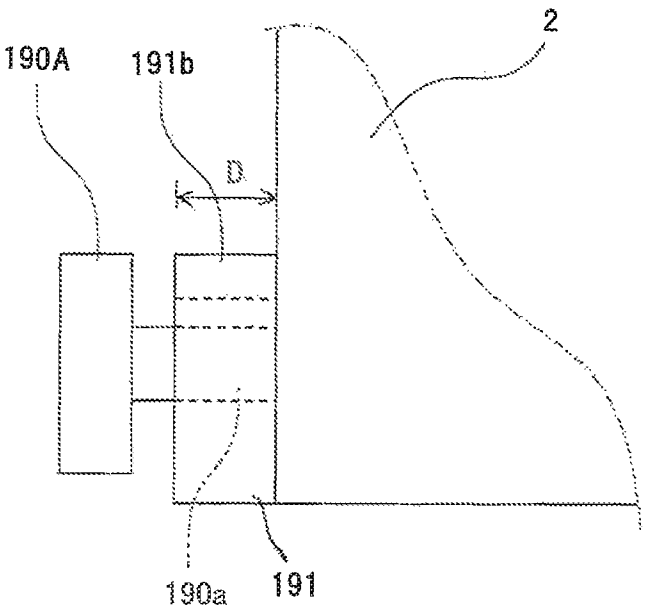
FIG. 7A is an explanatory view showing a configuration of a second detecting portion for detecting a cartridge contained in the image forming apparatus and FIG. 7B is a view viewed from an arrowed direction A of FIG. 7A.
Figure 7A:
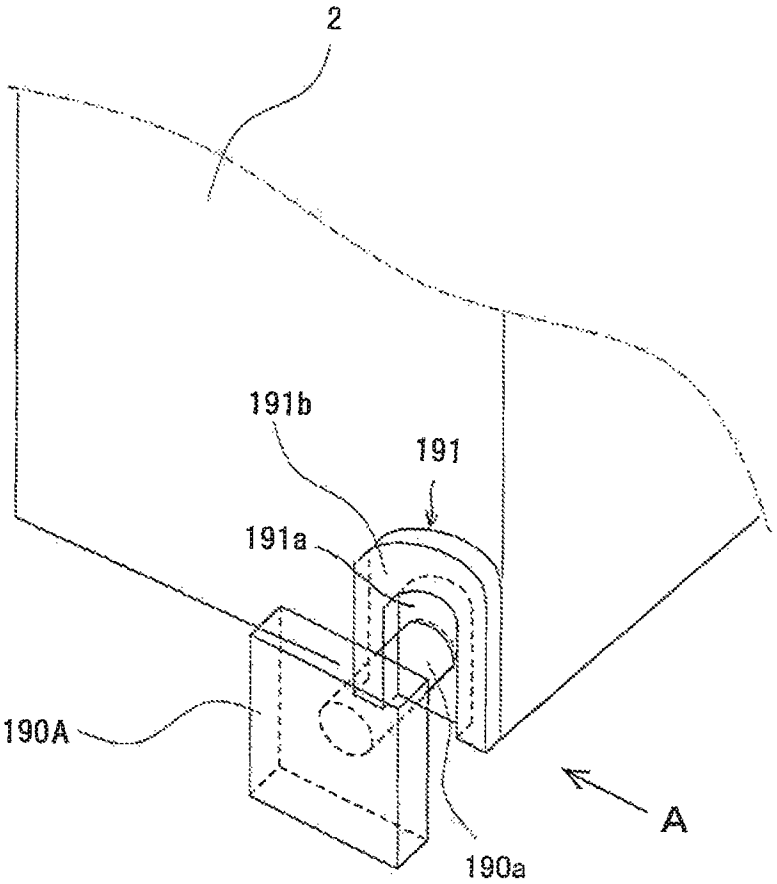

FIG. 6 is an explanatory view showing a configuration of a cartridge attachment portion of the image forming apparatus 100A of the present embodiment, FIG. 7A is an explanatory view showing a configuration of a second detecting portion for detecting the cartridge 2 contained in the image forming apparatus 100A, and FIG. 7B is a view viewed from an arrowed direction A of FIG. 7A.

The image forming apparatus 100A of the present embodiment is comprised of, as shown in FIG. 6, the moving portion 170A for moving the process cartridge 2 to the cartridge attachment portion (attachment portion) 111 inside the apparatus main body 110A; the front cover 150A for opening and closing the cartridge attachment portion 111; a safety switch (first detecting portion) 180 for detecting that the front cover 150A is closed, and respective stroke switches (second detecting portions) 190A for detecting respective positions of respective process cartridges 2.

The front cover 150A has one side in a height direction of the image forming apparatus 100A as a fixed end 150*a* and the other side as a free end 150*b*. Then, it is configured such that a rotation fulcrum 151 is provided on the side of the fixed end 150*a* of the front cover 150A, and the side of the free end 150*b* is rotatable. Specifically, the front cover 150A is configured so that the rotation fulcrum 151 is arranged on the lower side and the free end 150*b* is arranged on the upper side so that the front cover 150 is rotatable in a vertical direction, as shown in FIG. 6.

The moving portion 170A is provided in the cartridge attachment portion 111, and is configured to convey the process cartridge 2 placed on the moving portion 170A to a predetermined position in the apparatus.

The safety switch 180 is arranged near the side of the free end 150*b* of the front cover 150A in the case of a state where the cartridge attachment portion 111 is closed by the front cover 150A.

On the other hand, provided on the side of the free end 150*b* of the front cover 150A is a safety switch pressing portion 152 for pressing the safety switch 180 when the cartridge attachment portion 111 is closed by the front cover 150A.

The stroke switch 190A is arranged at a position abutting against the process cartridge 2 when the process cartridge 2 is contained in the cartridge attachment portion 111 normally.

A urging portion 153 that, in the case of rotating the front cover 150A to the state of closing the cartridge attachment portion 111, abuts against the moving portion 170 to urge the process cartridge 2 to a predetermined position in the cartridge attachment portion 111 is protrudingly provided on the side of the rotation fulcrum 151 of the front cover 150A. Note that, the urging portion 153 may abut against the process cartridge 2 directly to urge the process cartridge 2 to the predetermined position.

As shown in FIG. 7A and FIG. 7B, the process cartridge 2 is provided with a stroke switch receiving portion 191 at an end portion on the side of a traveling direction in which the process cartridge 2 is attached toward the inside of the apparatus main body 110A, which is at a position facing the stroke switch 190A.

In the stroke switch receiving portion 191, a through hole 191*a* that enables a front end portion 190*a* of the stroke switch 190A to be in contact with the process cartridge 2 is formed. That is, the stroke switch receiving portion 191 has the through hole 191*a* and a convex portion 191*b* having an inverse-U shape viewed from the side of the stroke switch 190A. The shape of the convex portion 191*b* is not limited.

A width D (FIG. 7B) concerning a conveyance direction of the process cartridge 2 of the convex portion 191*b* may have a length which is able to be measured by the stroke switch 190. Accordingly, the width D (FIG. 73) of the stroke switch receiving portion 191 is able to be determined arbitrarily by the stroke switch 190A which is used, through experiments or the like.

When the process cartridge 2 is conveyed to an appropriate position, the front end portion 190*a* of the stroke switch 190A is to be in contact with the process cartridge 2 via the through hole 191*a* to be pressed only by predetermined length (appropriate position length). In this case, the stroke switch 190A outputs a signal (appropriate position signal) showing that the process cartridge 2 is arranged at the appropriate position (image formation position) in the cartridge attachment portion 111.

On the other hand, when the process cartridge 2 is conveyed being deviated from the appropriate position, the front end portion 190*a* of the stroke switch 190A is to be pressed by the stroke switch receiving portion 191. Therefore, the stroke switch 190A detects being pressed more only by the width D of the stroke switch receiving portion 191 in addition to the predetermined length (appropriate position length). When the front end portion 190*a* is pressed longer only by the length D than the appropriate position length, the stroke switch 190A does not output the appropriate position signal.

A size and a shape of the through hole 191*a* of the stroke switch receiving portion 191 when viewed from the side of the stroke switch 190A are able to be determined arbitrarily through experiments or the like, in view of a size of the front end portion 190*a* of the stroke switch 190A which is used and an allowable space range between a formation face of the concave portion 191*a* of the stroke switch receiving portion 191 and the front end portion 190*a* (degree of allowable deviation concerning the appropriate position of the process cartridge 2) and the like.

In the present embodiment, the stroke switch 190A detects that the process cartridge 2 is arranged at the image formation position in the apparatus with the allowable range of several mm or less.

The stroke switch 190A may be one by which the above-described working effect is able to be obtained, and, for example, one manufactured by OMRON Corporation (model. B3SL-1022P) is usable. This makes it possible to perform measure with position measuring accuracy of the process cartridge 2 as ±0.2 mm. In particular, since the model B3SL-1022P has a seal configuration, by using in the image forming apparatus in which dust soars, it is possible to detect the position of the process cartridge 2 accurately for a much longer period of time.

Moreover, the safety switch 180 may be one which is able to detect a closed state of the front cover 150A, and, for example, a push switch manufactured by Shinden Co., Ltd. (SDP-106A-21) is usable. Note that, without limitation thereto, the stroke switch described above may be used.

Further, as shown in FIG. 4, in the image forming apparatus 100A, the display portion 131 is configured as a first notifying portion for visually notifying a user of a state of the image forming apparatus 100A as well as the speaker 132 is configured as a second notifying portion for aurally notifying the user of a state of the image forming apparatus 100A.

Next, description will be given for a main electric configuration of the image forming apparatus 100A of the present embodiment with reference to a block diagram.

Figure 8:
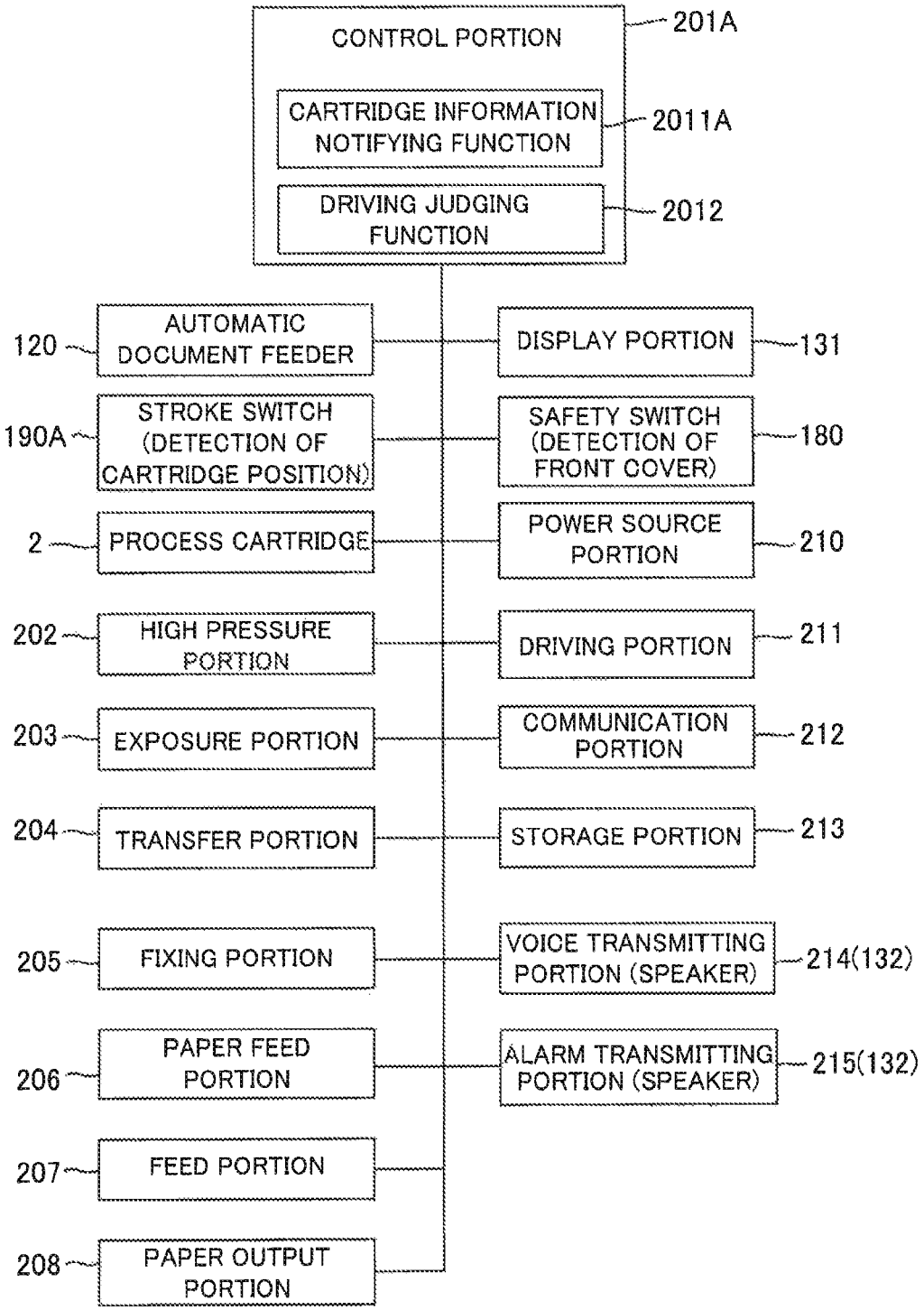
FIG. 8 is a block diagram showing an electric configuration of the image forming apparatus.

FIG. 8 is a block diagram showing an electric configuration of the image forming apparatus 100A of this first embodiment.

As shown in FIG. 8, the image forming apparatus 100A is provided with, as the electric configuration, a control portion 201A for controlling actions of the image forming apparatus 100A, a high pressure portion 202, an exposure portion 203, a transfer portion 204, a fixing portion 205, a paper feed portion 206, a feed portion 207, a paper output portion 208, a power source portion 210, a driving portion 211, a communication portion 212, a storage portion 213, a voice transmitting portion (speaker) 214, an alarm transmitting portion (speaker) 215, and the like.

In the present embodiment, the speaker 132 is configured so as to function as the voice transmitting portion 214 and the alarm transmitting portion 215.

In addition to the configuration described above, the control portion 201A is connected to each of the automatic document feeder 120, the display portion 131, the safety switch 180, the stroke switch 190A, the process cartridge 2 and the like, and controls the whole image forming apparatus 100A.

In addition, the control portion 201A is characterized by including a cartridge information notifying function 2011A and a driving judging function 2012.

When it is detected by the safety switch 180 that the front cover 150A (FIG. 4, FIG. 6) is closed, but the process cartridge 2 is not detected by the stroke switch 190A (when the control portion 201A does not receive the appropriate position signal), the cartridge information notifying function 2011A notifies information (cartridge confirmation indicating information) showing that the process cartridge 2 is not at the appropriate position by the display portion 131 and the speaker 132 by means of display and sound.

When it is detected by the safety switch 180 that the front cover 150A is closed, the driving judging function 2012 judges whether or not to permit driving of the image forming apparatus 100A according to a detection result of the process cartridge 2 by the stroke switch 190A.

Specifically, when it is detected by the safety switch 180 that the front cover 150A is closed and the process cartridge 2 is not detected by the stroke switch 190A (when the control portion 201A does not receive the appropriate position signal), the driving judging function 2012 does not permit driving of the image forming apparatus 100A, and when the process cartridge 2 is detected, permits driving of the image forming apparatus 100A.

Here, description will be given for an example of displaying cartridge confirmation indicating information on the display portion 131 of the operation panel 130 in notifying processing by the cartridge information notifying function 2011A of the control portion 201A of the present embodiment.

FIG. 9A to FIG. 9D are explanatory views showing an example of cartridge confirmation indicating information displayed on the display portion of the image forming apparatus 100A of the present embodiment.

Figure 9A:
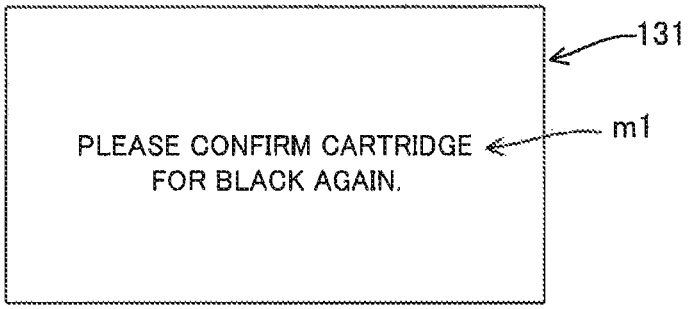
FIG. 9A to FIG. 9D are explanatory views showing an example of cartridge information displayed on a display portion of the image forming apparatus of this first embodiment.

In the image forming apparatus 100A, for example, when the stroke switch 190A for detecting the process cartridge 2 for black does not detect the process cartridge 2, a message m1 of "Please confirm cartridge for black again." (cartridge confirmation indicating information) may be displayed on the display portion 131 of the operation panel 130, as shown in FIG. 9A.

Figure 9B:
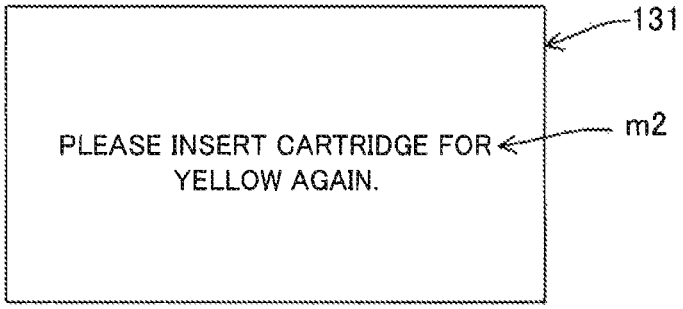

Further, for example, in the case of attaching the process cartridge 2 for yellow, when the stroke switch 190A does not detect the process cartridge 2, a message m2 of "Please insert cartridge for yellow again." (cartridge confirmation indicating information) may be displayed on the display portion 131 of the operation panel 130, as shown in FIG. 9B.

Figure 9C:
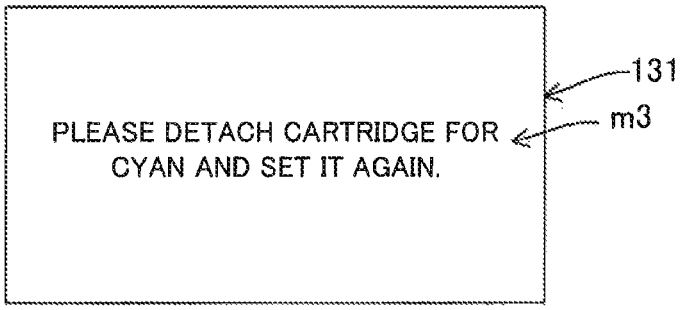

Further, for example, in the case of attaching the process cartridge 2 for cyan, when the stroke switch 190A does not detect the process cartridge 2, a message m3 of "Please detach cartridge for cyan and set it again." (cartridge confirmation indicating information) may be displayed on the display portion 131 of the operation panel 130, as shown in FIG. 9C.

Figure 9D:
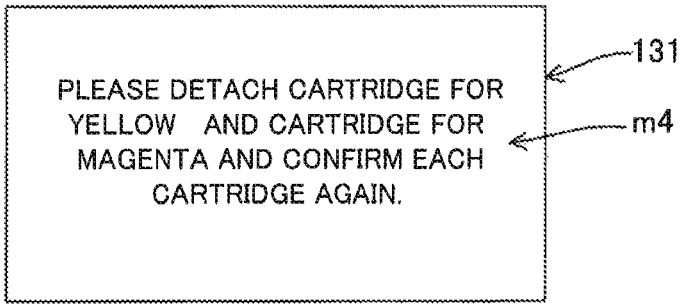

Further, for example, in the case of attaching the process cartridges 2 for yellow and magenta, when the stroke switch 190A does not detect each of the process cartridges 2, a message m4 of "Please detach cartridges for yellow and cartridge for magenta and confirm each cartridge again." (cartridge confirmation indicating information) may be displayed on the display portion 131 of the operation panel 130, as shown in FIG. 9D.

Note that, here, as means for notifying the user of cartridge confirmation indicating information, notification is performed visually by displaying cartridge confirmation indicating information on the display portion 131 by means of a message, but cartridge confirmation indicating information may be notified aurally by means of voice guidance.

The voice guidance is transmitted from the speaker 132 as shown in FIG. 4.

The number of times of the voice guidance may be once or a plurality of times.

For example, the number of times of the voice guidance may be set by operating the operation panel 130 by the user. Moreover, setting may be performed so as to perform the transmission during the time till when the safety switch 180 is turned on again after the front cover 150A is closed.

Further, as means for notifying the user of cartridge confirmation indicating information, alarm may be enabled to be set in the same manner as the voice guidance.

Next, description will be given for processing a procedure of cartridge confirmation in the case of replacing the process cartridges 2 in the image forming apparatus 100A of this first embodiment based on a flowchart.

Figure 10:
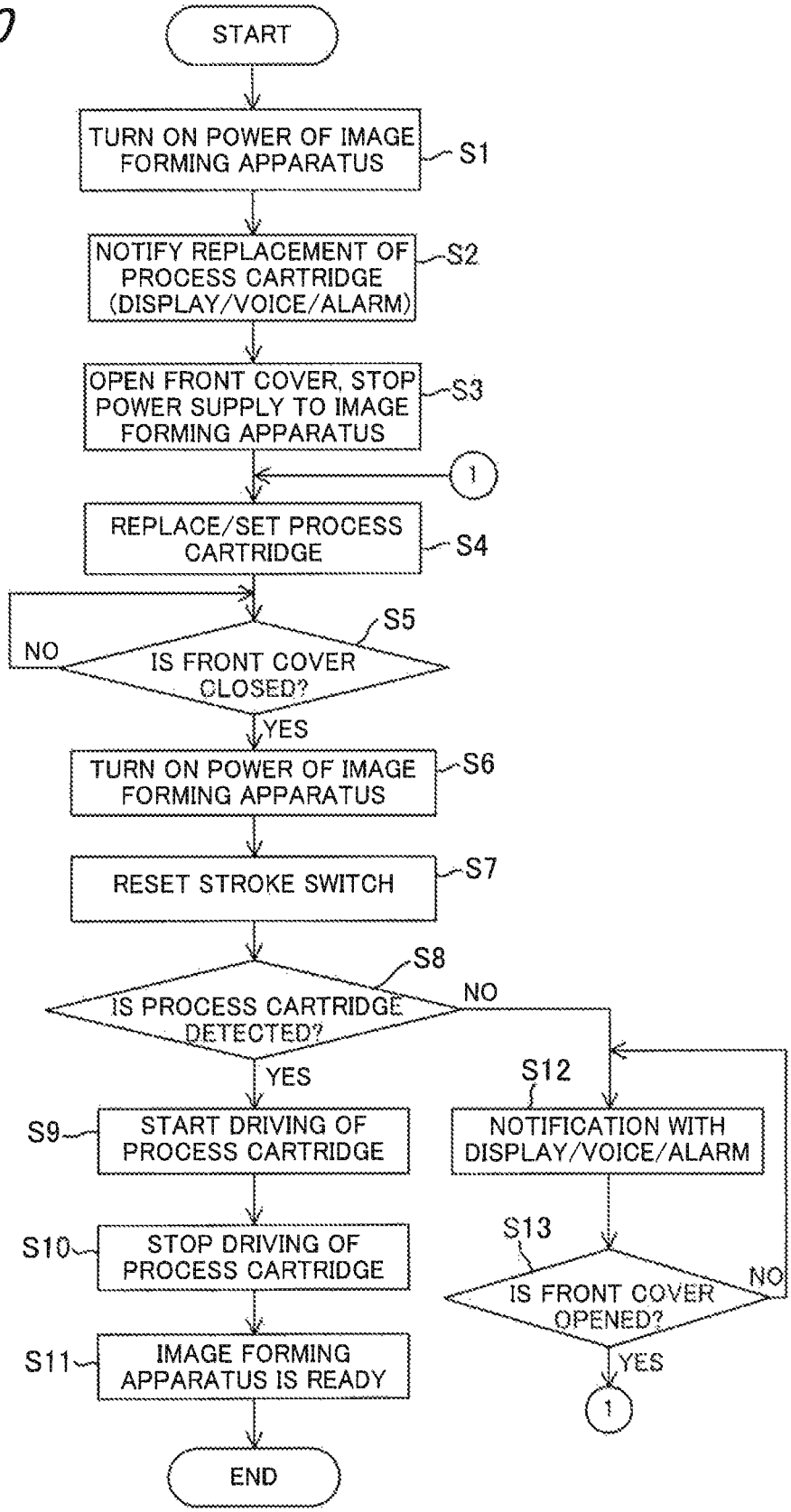
FIG. 10 is a flowchart showing procedure of cartridge confirmation in the case of replacing the process cartridges in the image forming apparatus.

FIG. 10 is a flowchart showing the procedure of cartridge confirmation in the case of replacing the process cartridges in the image forming apparatus 100A of the present embodiment.

In the present embodiment, when the process cartridge 2 is replaced in the image forming apparatus 100A, cartridge confirmation processing as to whether or not the target process cartridge 2 is attached appropriately is executed.

First, in a state where power of the image forming apparatus 100A is turned on (step S1), when the process cartridge 2 needs to be replaced, information (cartridge replacement indicating information) that the process cartridge 2 needs to be replaced is notified (step S2). This cartridge replacement indicating information is able to be notified by display of a message on the display portion 131 or voice guidance or alarm with the speaker 132.

When a user opens the front cover 150A of the image forming apparatus 100A based on the cartridge replacement indicating information (when opening of the front cover 150A is detected by the safety switch 180), then, the control portion 201A stops power supply to the image forming apparatus 100A (step S3).

Furthermore, based on the cartridge replacement indicating information, the user takes out the target process cartridge 2 from the cartridge attachment portion 111 and sets a new process cartridge 2 at a predetermined position of the apparatus main body 110A (cartridge attachment portion 111), thereby performing replacement of the cartridges. Then, the user closes the front cover 150A (step S4).

Furthermore, whether or not the front cover 150A is closed is judged (step S5).

Confirmation of the opening and closing state of the front cover 150A is judged by an output result of the safety switch 180. Whether or not to permit driving of the image forming apparatus 100A is then judged by the driving judging function 2012.

When it is judged that the front cover 150A is closed at step S5, power of the image forming apparatus 100A is turned on (step S6).

Then, the stroke switch 190A is reset (step S7), and whether or not the replaced process cartridge 2 is detected is judged (step S8).

Detection of the process cartridge 2 is judged based on an output result of the stroke switch 190A.

Here, description will be given specifically for detection of the replaced process cartridge 2.

As to which process cartridge 2 is replaced among a plurality of kinds of process cartridges 2, for example, a detection signal of a not-shown photo sensor for detecting emptiness of a toner in a toner container (developing tank 24 (FIG. 5B)) of the process cartridge 2 is detected, and information identifying the stroke switch 190A at a position corresponding to the process cartridge 2 which has become empty is stored in the storage portion 213 (FIG. 8) of the image forming apparatus 100A.

Thereby, it is detected by the stroke switch 190A that the process cartridge 2 which has become empty is removed from the image forming apparatus 100A and a new process cartridge 2 is inserted in the image forming apparatus 100A, thus making it possible to confirm that the target process cartridge 2 is replaced.

When it is judged at step S8 that the replaced process cartridge 2 is detected by the stroke switch 190A, driving of the process cartridge 2 is started (step S9), and after a predetermined period of time, driving of the process cartridge 2 is stopped (step S10), and thereafter the image forming apparatus 100A is set to a stand-by state (step S11). Then, the replacement processing of the process cartridges 2 in the image forming apparatus 100A is finished.

On the other hand, when it is judged at step S8 that the replaced process cartridge 2 is not detected by the stroke switch 190A, cartridge confirmation indicating information that the process cartridge 2 is not attached appropriately is notified by display of a message, voice guidance or alarm (step S12). The notification of the cartridge confirmation indicating information is performed by the cartridge information notifying function 2011A with display of a message, voice guidance or alarm by the display portion 131 and the speaker 132.

Then, subsequent to step S12, whether or not the front cover 150A is opened is judged (step S13).

When it is judged that the front cover 150A is not opened at step S13, the notification of the cartridge confirmation indicating information (display of the message, voice guidance or alarm) is continued until the front cover 150A is opened.

When it is judged that the front cover 150A is opened at step S13, the procedure returns to step 4, and replacement processing of the process cartridges 2 is confirmed and executed.

Hereinafter, the processing is executed based on the flowchart as described above.

In this manner, the replacement processing of the process cartridges 2 in the image forming apparatus 100A is finished.

This makes it possible to replace the target process cartridge 2 reliably in the image forming apparatus 100A.

As described above, the image forming apparatus 100A to which a plurality of process cartridges 2 are to be attached, is comprised of the cartridge attachment portion 111 to which each of the plurality of process cartridges 2 is attached to be attachably and detachably disposed, the front cover 150A which is provided so as to be rotatable with respect to the apparatus main body 110A for opening and closing the cartridge attachment portion 111, the moving portion 170 for moving the process cartridge 2 to an image formation position in conjunction with an action of closing the front cover 150A, and the control portion 201A for controlling an action of each portion, and forms an image on recording medium (sheet P) using a recording material (toner) contained in the process cartridge 2.

The image forming apparatus 100A is comprised of the safety switch (first detecting portion) 180 for detecting that the front cover 150A is closed, the stroke switches (second detecting portions) 190A for detecting positions of the process cartridges 2, and the display portion 131 and the speaker 132 as notification means for notifying the user of states of the process cartridges 2.

The control portion 201A is comprised of a cartridge information notifying function 2011 that, when it is detected by the safety switch 180 that the front cover 150A is closed, while the process cartridge 2 is not detected by the stroke switch 190A, notifies the display portion 131 and the speaker 132 of cartridge confirmation indicating information showing that the process cartridge 2 is not at the appropriate position. Owing to the cartridge information notifying function 2011, in the case of attaching the process cartridge 2 to the image forming apparatus 100A, it is possible to confirm that the process cartridge 2 is contained in a normal state without an incorrect operation of the process cartridge 2. This makes it possible to prevent that, for example, the process cartridge 2 to which a foreign object is adhered without user's knowing, is inserted in the image forming apparatus 100A as it is, so that, due to the abnormal attachment of the process cartridge 2, a driving gear and the like are broken or an intermediate transfer belt, a photosensitive member and the like are damaged.

Moreover, owing to the cartridge information notifying function 2011A, by informing the user that the process cartridge 2 is forgotten to be attached to the image forming apparatus 100A, it is possible to perform replacement working of the process cartridge 2 reliably.

Further, according to the present embodiment, by including the driving judging function 2012 as the function of the control portion 201A of the image forming apparatus 100A, it is possible to prevent the image forming apparatus 100A from operating in a state where the process cartridge 2 is not attached appropriately to the image forming apparatus 100A. Thereby, it is possible to prevent that a driving gear and the like are broken due to abnormal attachment of the process cartridge 2, or an intermediate transfer belt, a photosensitive member and the like are damaged by the foreign object.

Further, according to the present embodiment, by using the stroke switch 190A as the second detecting portion, without being subjected to a bad influence of electromagnetic wave like a non-contact IC tag nor subjected to influences of fine particles and dusts in the image forming apparatus like a photo sensor, it becomes possible to detect a position of the cartridge 2 stably over a long period of time.

Further, according to the present embodiment, the configuration of the process cartridge 2 is set as the unit configuration provided with the photosensitive member drum 3, the cleaner unit 4, the charging roller 5, and the developing device 20, it is possible to configure an image forming portion compactly and to realize the image forming apparatus 100A with a saved space.

Further, according to the present embodiment, by providing the display portion 131 and the speaker (voice transmitting portion, alarm transmitting portion) 132 so as to function as notification means, for example, even if the user is a visually weak person, it is possible to transmit notification contents of cartridge confirmation indicating information or the like reliably.

Further, according to the present embodiment, as the configuration of the image forming apparatus 100A, it is configured such that a plurality of process cartridges 2 are provided and the plurality of process cartridges 2 are arranged, in parallel, in the oblique direction with respect to the horizontal direction of the image forming apparatus 100A (FIG. 5), thus making it possible to realize the image forming apparatus 100A with a saved space by suppressing a size in a width direction of the image forming apparatus 100A.

Note that, though description has been given for the configuration that the stroke switch receiving portion 191 is provided at the position facing the stroke switch 190A of the process cartridge 2 in the above-described embodiment, the present invention is not limited thereto. The configuration in which the configuration of the moving portion 170 is changed without providing the stroke switch receiving portion 191 will be described in the following second embodiment. Note that, in the description of the second embodiment, same reference numerals are assigned to the same components as the first embodiment, and description thereof will be omitted.

Hereinafter, description will be given for a mode for carrying out an image forming apparatus 100B according to the second embodiment of the present invention with reference to drawings.

Figure 11:
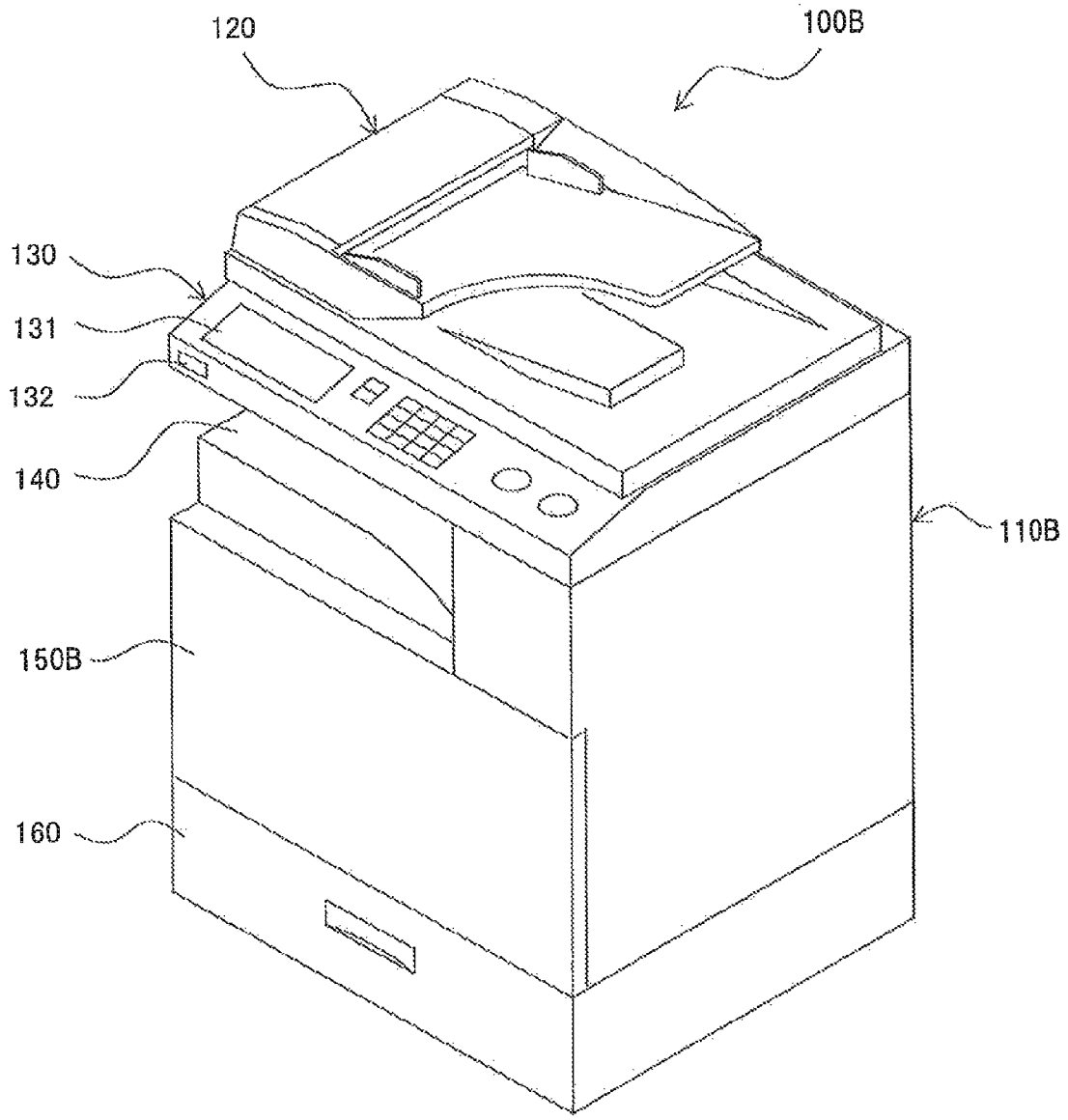
FIG. 11 is an explanatory view showing a whole configuration of an image forming apparatus according to a second embodiment of the present invention.
Figures 12A, 12B:
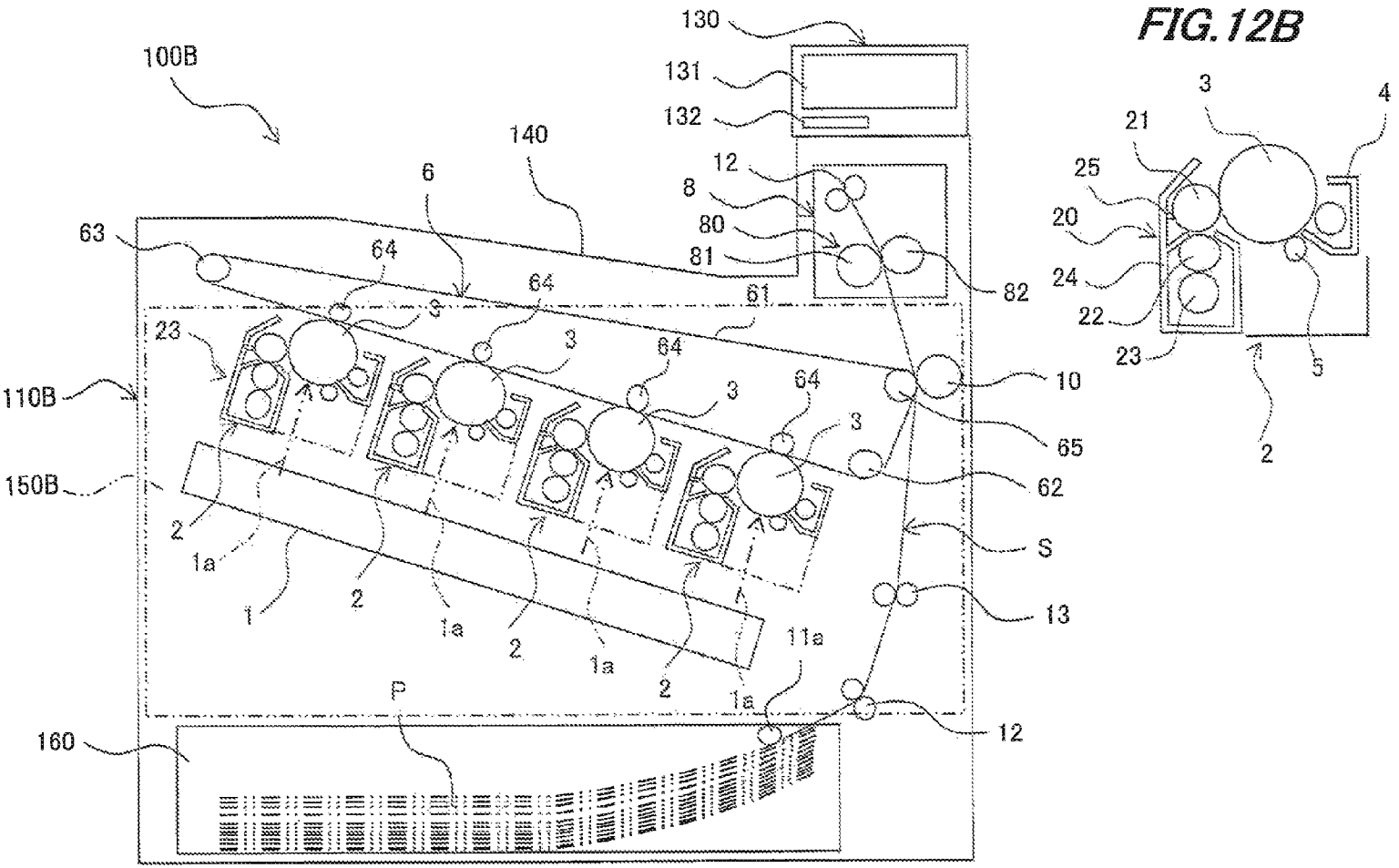
FIG. 12A is an explanatory view showing a configuration of a main part of the image forming apparatus and FIG. 12B is an explanatory view of a process cartridge used for the image forming apparatus.

FIG. 11 is an explanatory view showing a whole configuration of the image forming apparatus 100B according to the second embodiment of the present invention, which is an example of modes for carrying out the invention, and FIG. 12A is an explanatory view showing a configuration of a main part of the image forming apparatus 100B, and FIG. 12B is an explanatory view of a process cartridge used for the image forming apparatus 100B.

The image forming apparatus 100B according to this second embodiment is comprised of, as shown in FIG. 11 and FIG. 12A, the plurality of process cartridges (cartridges) 2, the cartridge attachment portion 111 for attaching each of the plurality of process cartridges 2 so as to be attachably and detachably disposed (see FIG. 13A, FIG. 13B), a front cover (opening and closing member) 150B for opening and closing the cartridge attachment portion 111, a moving portion 170B (FIG. 13A, FIG. 13B) for moving the process cartridge 2, and a control portion 201B for controlling an action of each portion, and forms an image on a recording medium (for example, sheet P) using recording material (for example, toners) contained in the process cartridge 2.

First, description will be given for a whole configuration of the image forming apparatus 100B.

In the following description, same reference numerals are assigned to the same parts. Names and functions thereof are also the same. Accordingly, detailed description thereof will not be repeated.

As shown in FIG. 11, the image forming apparatus 100B forms a multicolor image and a monocolor image on a predetermined sheet P (FIG. 12A) (for example, recording paper) according to image data transmitted from the outside of the image forming apparatus 100B, and is comprised of an apparatus main body 110B and the automatic document feeder (ADF) 120.

On an upper part of the operation side of the apparatus main body 110B, an operation panel 130 is provided.

The operation panel 130 is provided with the display portion 131 and the speaker (notifying portion) 132.

As the display portion 131, a display device such as a liquid crystal display (LCD) with a backlight, an organic ELD (Electro Luminescence Display), a display such as electronic paper using electrophoresis, a plasma display (PDP), a plasma tube array display (PTAD), or a display using an electron emitting element (FED, SED) is usable. The display portion 131 displays a screen including an instruction menu such as a setting screen to a user and information concerning obtained image data.

A paper output tray 140 is configured below the operation panel 130.

At a center part with respect to a height direction of the apparatus main body 110B on the operation side of the apparatus main body 110B (the side in which the display portion 131 is arranged), the front cover (opening and closing member) 150B for opening and closing an attachment portion inside the apparatus to which a cartridge is attached is provided. In a lower part of the apparatus main body 110B, a paper feed cassette (recording medium container) 160 is provided.

That is, as shown in FIG. 12A, the apparatus main body 110B is comprised of the plurality of process cartridges 2, the exposure unit 1, the transfer portion 6, the fixing unit 8, the paper output tray 140, the paper feed cassette 160 and the like. Each process cartridge 2 has the photosensitive member drum 3, the cleaner unit 4 and the charging roller 5.

The reference numeral 1*a* in the figure denotes the exposure light path.

On an upper part of the apparatus main body 110B, the automatic document feeder 120 is disposed (FIG. 11).

The automatic document feeder 120 conveys a document automatically onto a not-shown platen glass on the top of the apparatus main body 110B.

Image data which the image forming apparatus 100 deals with corresponds to a color image using each color of black (B), cyan (C), magenta (M), and yellow (Y).

Accordingly, four process cartridges 2 are provided so that four kinds of latent images corresponding to each color are developed. That is, the process cartridge 2 for black, the process cartridge 2 for cyan, the process cartridge 2 for magenta, and the process cartridge 2 for yellow are provided one for each image station respectively, which constitute four image stations.

Moreover, development may be formed with six colors by providing six image stations, for example, by adding process cartridges for light cyan (LC) and light magenta (LM) which have the property of the same color phase as the cyan (C) and magenta (M) and a lower density than the cyan (C) and magenta (M), in addition to black (B), cyan (C), magenta (M), and yellow (Y).

These six colors make it possible to obtain a high-quality full color image which is more vivid.

As shown in FIG. 12A, the four process cartridges 2 are arranged in parallel with a predetermined interval with respect to the travelling direction of the intermediate transfer belt 61, which are provided so that the process cartridges 2 on one side with respect to the traveling direction become higher and the process cartridges 2 on the other side become lower. That is, they are arranged, in parallel, in an oblique direction with respect to a horizontal direction of the image forming apparatus 100B (so that the process cartridges 2 on the left side become higher and the process cartridges 2 on the right side become lower in FIG. 12A).

The charging roller 5 (FIG. 12B) is charging means for uniformly charging the surface of the photosensitive member drum 3 at the predetermined potential.

The exposure unit 1 (FIG. 12A) is the image writing device which exposes the charged photosensitive member drum 3 according to image data input from outside or image data obtained by reading a document to thereby form the electrostatic latent image according to the image data on the surface of the photosensitive member drum 3. In the exposure unit 1, a polygon mirror for scanning laser beams, and optical elements such as lenses and mirrors for guiding laser beams reflected by the polygon mirror to the photosensitive member drum 3 are arranged.

The process cartridge 2 includes, as shown in FIG. 12B, the photosensitive member drum 3, the cleaner unit 4, the charging roller 5 and the developing device 20, and visualizes the electrostatic latent images formed on each of the photosensitive member drums 3 with toners of four colors (Y, M, C, B).

The developing device 20 has the developing roller 21, the first toner conveying roller 22, the second toner conveying roller 23, the developing tank (toner container) 24 and the doctor blade 25.

As to toner supply to the developing roller 21, by frictional charging between the second toner conveying roller 23 and toners, the toners are adhered to the surface of the second toner conveying roller 23, by frictional charging, the toners on the surface of the second toner conveying roller 23 are adhered to the surface of the first toner conveying roller 22, and the toners on the surface of the first toner conveying roller 22 are finally regulated to have appropriate toner layer thickness by the doctor blade 25 and supplied to the surface of the developing roller 21 by frictional charging.

In the present embodiment, the second toner conveying roller 23 has the roller shape, but the shape is not limited thereto, if it is the shape capable of scraping the toners accumulated in the bottom part of the developing tank 24 to supply to the surface of the first toner conveying roller 22.

Moreover, a developer used for the image forming apparatus 100B of the present embodiment may be a dual-component developer in which toners and carriers are mixed.

The photosensitive member drum 3 has the cylindrical form and is disposed over the exposure unit 1 (see FIG. 12A), the surface thereof is cleaned by the cleaner unit 4, and the cleaned surface is uniformly charged by the charging roller 5.

The cleaner unit 4 removes and collects the toners remained on the surface of the photosensitive member drum 3 after development and the image transfer.

The transfer portion 6 (refer to FIG. 12A) that is arranged above the photosensitive member drum 3 is comprised of the endless intermediate transfer belt (endless belt) 61, the intermediate transfer belt driving roller 62, the intermediate transfer belt driven roller 63, the intermediate transfer rollers 64 and the intermediate transfer belt support roller 65. Four intermediate transfer rollers 64 are provided corresponding to each color of Y, M, C and B.

The intermediate transfer belt 61 is configured so as to be stretched out and rotationally driven by the intermediate transfer belt driving roller 62, the intermediate transfer belt driven roller 63, the intermediate transfer rollers 64 and the intermediate transfer belt support roller 65.

The intermediate transfer belt 61 is formed into an endless shape using the film with thickness of about 100 μm to 150 μm, and is provided so as to be in contact with each photosensitive member drum 3 of the four process cartridges 2. Then, by sequentially superimposing and transferring, on the intermediate transfer belt 61, toner images in respective colors that are formed on the photosensitive member drum 3, the color toner image (multicolor toner image) is formed on the intermediate transfer belt 61.

The intermediate transfer roller 64 is the roller whose surface is covered with the conductive elastic material (for example, EPDM (ethylene propylene diene rubber), urethane foam or the like), and transfer bias for transferring the toner image on the photosensitive member drum 3 onto the intermediate transfer belt 61 is applied to the intermediate transfer belt 61. Specifically, to the intermediate transfer roller 64, high-voltage transfer bias (high voltage with polarity (+) opposite to charging polarity (−) of toners) is applied in order to transfer the toner image.

As described above, the toner images visualized corresponding to each color phase on each of the photosensitive member drums 3 are laminated on the intermediate transfer belt 61. The toner image as information of the laminated image is conveyed with the intermediate transfer belt 61, moved to the contact position of the sheet P to be conveyed and the intermediate transfer belt 61 (secondary transfer position, predetermined position) and transferred onto the sheet P by the transfer roller 10 arranged at this contact position.

The paper feed cassette 160 (FIG. 12A) is the tray for stacking the sheet to be used for image formation and is provided under the exposure unit 1 of the apparatus main body 110B.

The paper output tray 140 for collecting the printed sheet P so that the printed side faces downward (facedown), is provided in the upper part of the apparatus main body 110B.

Further, provided in the apparatus main body 110B is a paper feed path S that extends in an approximately vertical direction to convey the sheet P of the paper feed cassette 160 to the paper output tray 140 by way of the transfer roller 10 and the fixing unit 8. The pickup roller 11*a*, the plurality of feed rollers 12, the registration roller 13, the transfer roller 10, the fixing unit 8 and the like are arranged in the vicinity of the paper feed path S from the paper feed cassette 160 to the paper output tray 140. Note that, only the pair of the feed rollers 12 is illustrated in FIG. 12A.

The feed rollers 12 are small rollers for promoting and assisting conveyance of the sheet P and are arranged along the paper feed path S.

The pickup roller 11*a* is provided in the vicinity of an end part of the paper feed cassette 160 so as to pick up the sheet P one by one from the paper feed cassette 160 to supply to the paper feed path S.

The registration roller 13 temporarily suspends the sheet P that is being conveyed along the paper feed path S. Thus, the registration roller has a function for conveying the sheet P to the transfer roller 10 at such a timing that a front end of the sheet P will meet a front end of an image data area (including a toner image formation area) on the intermediate transfer belt 61.

The fixing unit 8 is comprised of a pair of a heat roller 81 and a pressing roller 82 as the fixing rollers 80, and the heat roller 81 and the pressing roller 82 rotate and convey the sheet so as to sandwich therebetween.

The heat roller 81 and the pressing roller 82 are arranged facing to each other, forming a fixing nip portion at the position where the heat roller 81 and the pressing roller 82 are put in press-contact with each other.

The heat roller 81 is temperature-controlled by the control portion 201B (FIG. 15) so as to be at a predetermined fixing temperature. This control portion 201B performs control so that the surface temperature of the heat roller 81 falls within a range of 160 to 200° C. based on the detected signal from a not-shown temperature detector (non-contact type thermistor) provided around the heat roller 81.

Moreover, the heat roller 81 has the function for thermally pressing the toners to the sheet in cooperation with the pressing roller 82 so as to thermally fix the multi-color toner image transferred onto the sheet, to the sheet, by fusing, mixing and pressing.

On the other hand, similarly to the heat roller 81, the pressing roller 82 is also configured by having the elastic layer formed on the peripheral surface of the cylindrical metal core. In addition, the pressing roller 81 abuts against the heat roller 81 with the predetermined pressure.

In addition, the image forming apparatus 100B is connected to the PC, the FAX and the data management server of the manufacturer, the sale destination, the lease destination or the like via a not-shown network line (LAN, telephone line or the like).

Figure 13A:
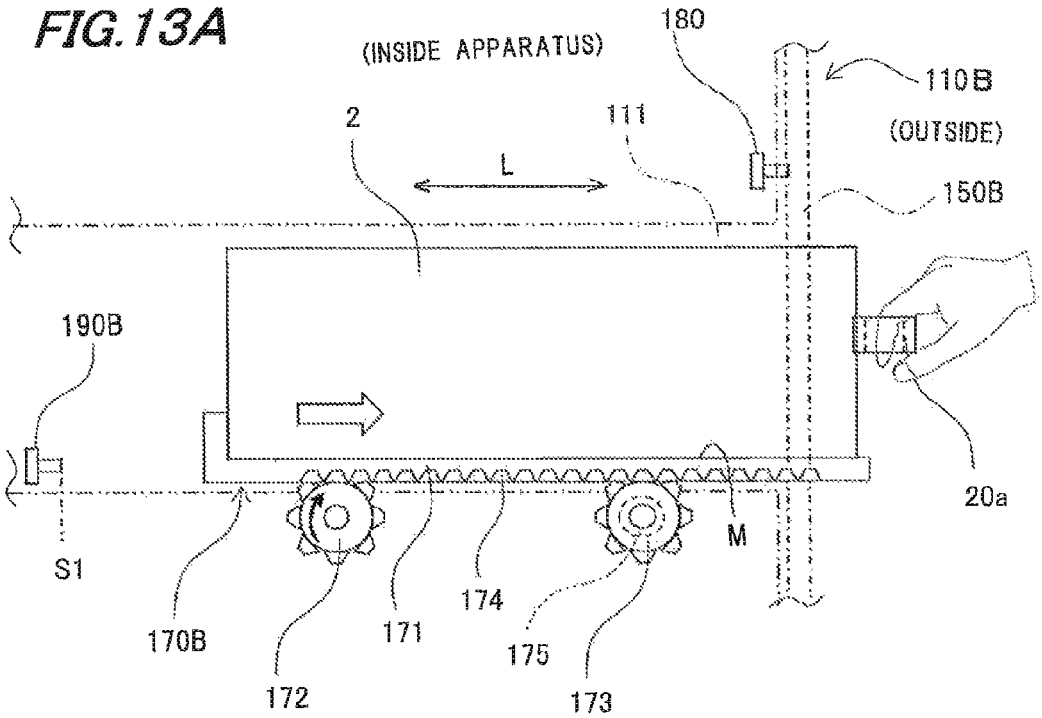
FIG. 13A is an explanatory view showing a state where the process cartridge is moved to the outside of the apparatus by a moving portion of the image forming apparatus and FIG. 13B is an explanatory view showing a state where the process cartridge is contained by the moving portion.
Figure 13B:
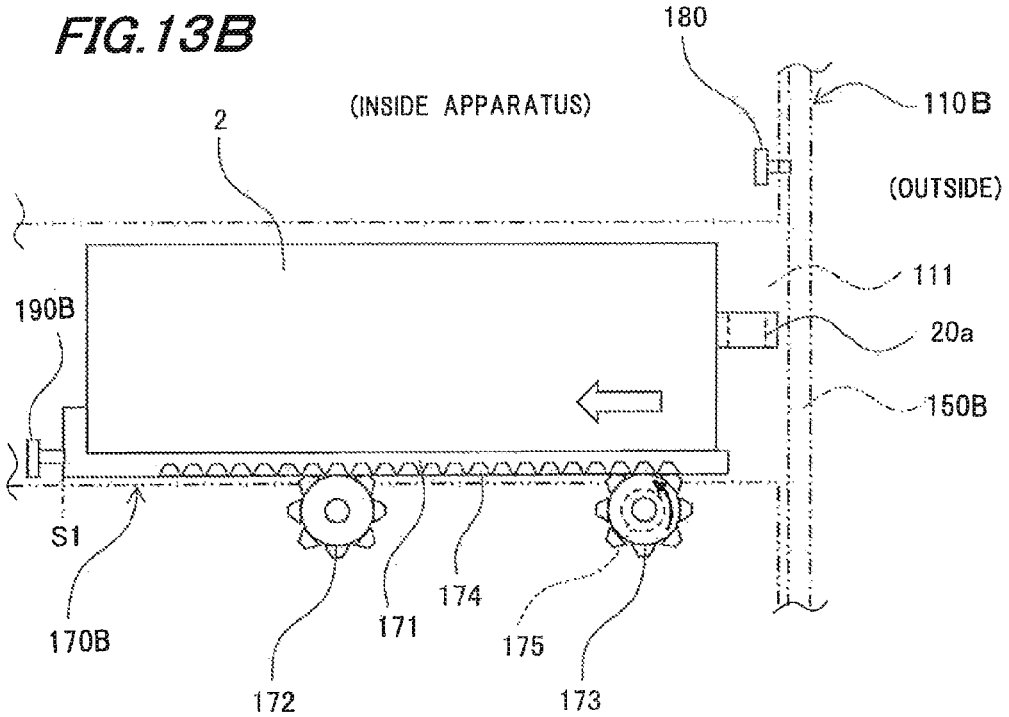
Figure 14:
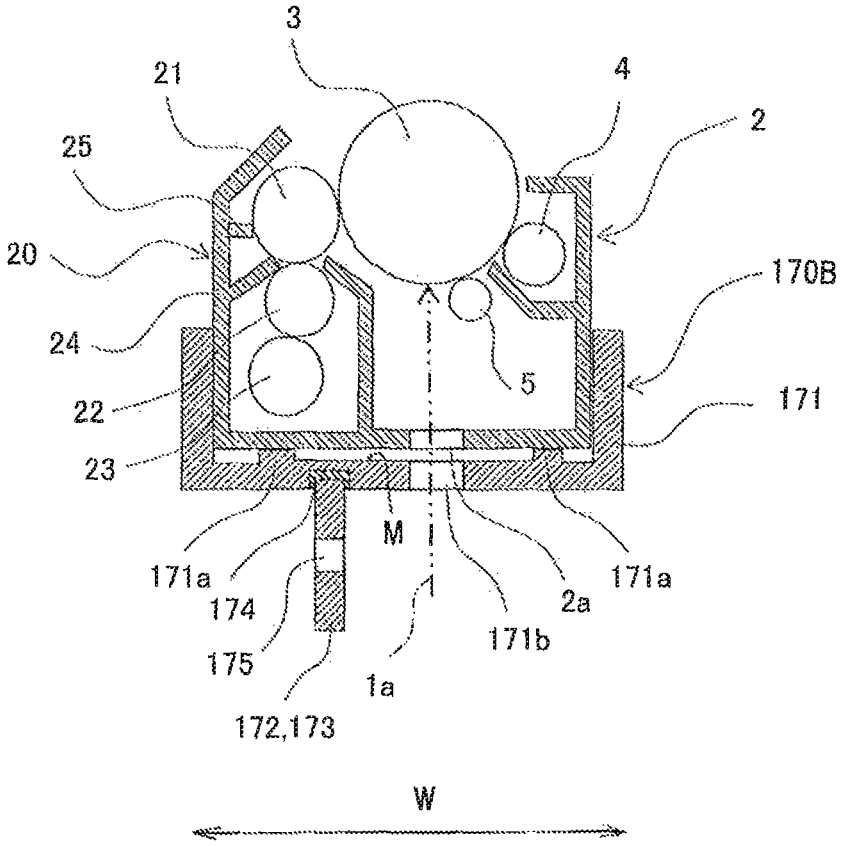
FIG. 14 is a vertical cross-sectional view of the process cartridge and the moving portion.

FIG. 13A is an explanatory view showing a state where the process cartridge 2 is moved to the outside of the apparatus by the moving portion 170B of the image forming apparatus 100B of the present embodiment, FIG. 13B is an explanatory view showing a state where the process cartridge 2 is contained by the moving portion 170B, and FIG. 14 is a vertical cross-sectional view of the process cartridge 2 and the moving portion 170B.

The image forming apparatus 100B of this second embodiment is comprised of, as shown in FIG. 13A and FIG. 13B, the moving portion 170B for moving the process cartridge 2 to the cartridge attachment portion (attachment portion) 111 inside the apparatus main body 110B; the front cover 150B for opening and closing the cartridge attachment portion 111; a safety switch (first detecting portion) 180 for detecting the front cover 150B; and respective push switches (second detecting portions) 190B for detecting respective presence and absence of respective process cartridges 2.

The front cover 150B may be configured such that one side in a height direction of the image forming apparatus 100B serves as a fixed end with a rotation fulcrum provided on the fixed end side and the other side serves as a free end with the free end side rotatable. Specifically, the front cover 150B may be configured such that the rotation fulcrum is arranged on the lower side and the free end is arranged on the upper side so that the front cover 150 is rotatable in a vertical direction.

As shown in FIG. 13A and FIG. 13B, the moving portion 170B is provided in the cartridge attachment portion 111, and is configured to convey the process cartridge 2 placed on it to a predetermined position in the apparatus.

In addition, the moving portion 170B is comprised of a process cartridge support board 171 for supporting the process cartridge 2 and driving gears 172 and 173 for moving the process cartridge support board 171, as shown in FIG. 14.

On the process cartridge support board 171, a groove 174 that is engaged with the driving gears 172 and 173 is provided on a lower face of a placement face M on which the process cartridge 2 is placed, continuously along a process cartridge insertion direction (longitudinal direction of the process cartridge 2), as shown in FIG. 13A, FIG. 13B, and FIG. 14.

Moreover, on an upper face of the placement face M, as shown in FIG. 14, a plurality of support portions 171*a* for supporting the process cartridge 2 are protrudingly provided along the longitudinal direction of the process cartridge 2. With such a configuration, it is possible to reduce a contact area between the support portions 171*a* and the lower face of the process cartridge 2 compared to that between the process cartridge support board 171 and the lower face of the process cartridge 2. Accordingly, when a user slides the process cartridge 2 on the process cartridge support board 171 in attaching or detaching the process cartridge 2 to or from the cartridge attachment portion 111, it is possible to reduce sliding friction between the process cartridge 2 and the placement face M (bottom face). Thus, the process cartridge support board 171 is able to support movement of the process cartridge 2 smoothly and stably in attaching or detaching the process cartridge 2 to or from the cartridge attachment portion 111.

Moreover, as shown in FIG. 14, on the process cartridge support board 171, a laser permeation port 171*b* is provided at a position facing a laser permeation port 2*a* provided on the bottom face of the process cartridge 2.

The laser permeation ports 2*a* and 171*b* are formed in a long hole shape along a longitudinal direction L of the process cartridge (that is, longitudinal direction of the photosensitive member drum 3) (FIG. 13A).

Figure 15:
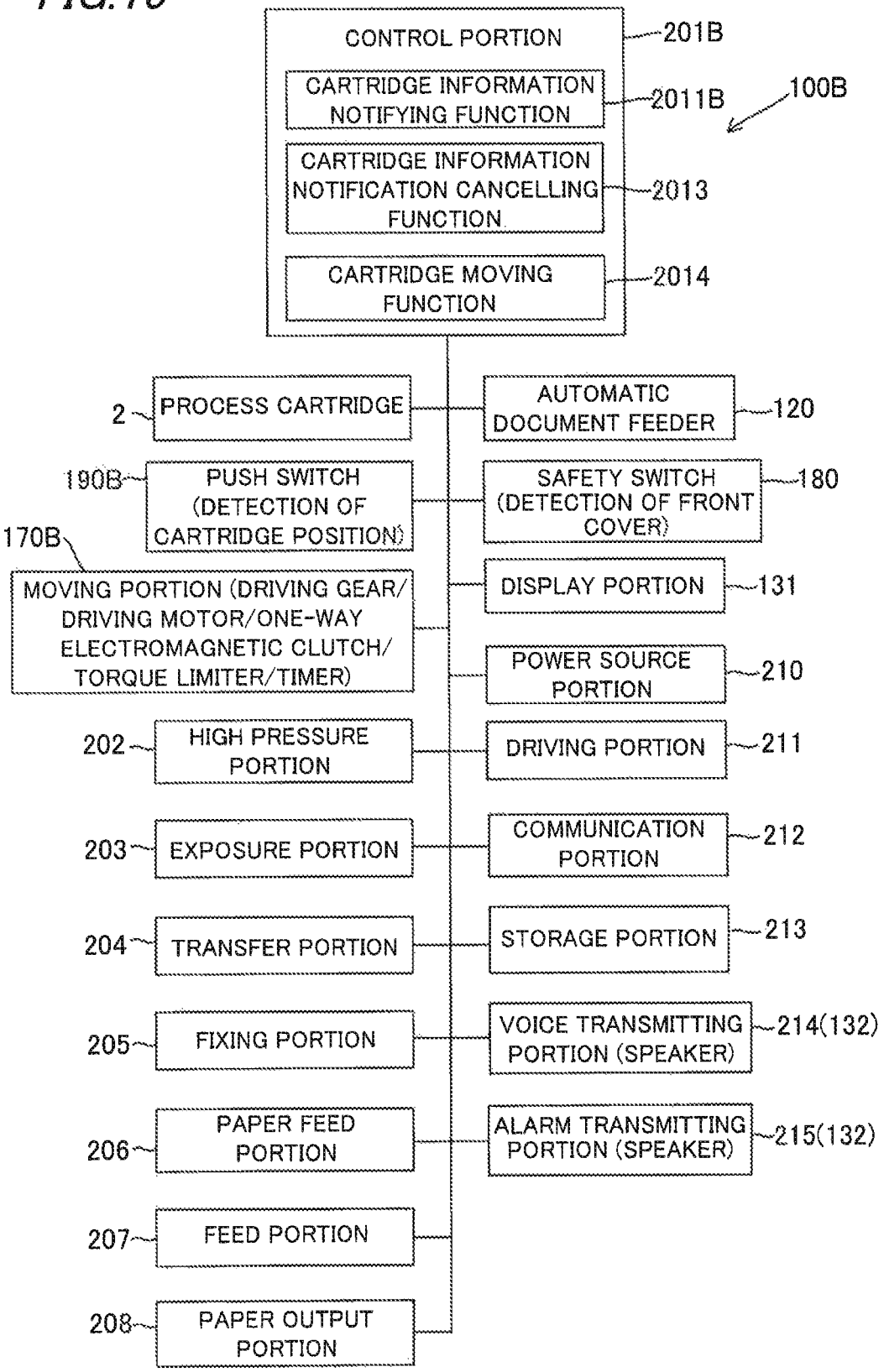
FIG. 15 is a block diagram showing an electric configuration of the image forming apparatus.

As shown in FIG. 13A, the driving gear 172 is configured to be rotationally driven in a clockwise direction by a not-shown driving motor, and by moving the process cartridge 2 from an image formation position S1 to a position outside the image forming apparatus (from left to right in the figure), stop after rotational driving of a predetermined period of time by a timer (see a reference numeral 170B in FIG. 15).

The driving gear 173 is configured so that driving from the not-shown driving motor is transmitted via a torque limiter (movable suppressing portion) (see the reference numeral 170B in FIG. 15). Then, as shown in FIG. 13B, the driving gear 173 is configured to be rotationally driven in a counter-clockwise direction by the not-shown driving motor, and by moving the process cartridge 2 from the position outside the image forming apparatus to the image formation position S1 (from right to left in the figure), when the process cartridge support board 171 abuts against a not-shown movement regulating member, stop rotational driving at the image formation position S1 with the torque limiter operated.

Each of the driving gears 172 and 173 is embedded with a one-way electromagnetic clutch 175 to regulate a rotational direction in which driving is applied. Note that, each of the driving gears 172 and 173 may be configured to use a two-way electromagnetic clutch.

In the present embodiment, the driving gears 172 and 173 are set to have a size of a extent of having no problem in practical use. Thereby, since it is possible to set a gap between the process cartridge support board 171 and a laser optical system (exposure unit 1; to be short, it is possible to provide the compact image forming apparatus 100B having low height direction.

Further, according to the present embodiment, since the driving gears 172 and 173 which are movable portions of the moving portion 170B are just below the vicinity of the center of a width direction W of a housing of the process cartridge 2 (FIG. 14), it is possible to move the process cartridge 2 with smooth linear movement, thus making it possible to perform stable movement so as not to incline the process cartridge 2 nor bring a cantilever state. The width direction W of the housing of the process cartridge 2 is the direction perpendicular to the longitudinal direction L of the process cartridge 2.

The safety switch 180 is arranged at a position where the safety switch abuts against the front cover 150B in such a state that the cartridge attachment portion 111 is closed by the front cover 150B.

The push switch 190B is arranged at a position where the push switch 190B abuts against the process cartridge support board 171 when the process cartridge 2 is contained in the cartridge attachment portion 111 normally.

The push switch 190B is able to be configured so as to output a signal (appropriate position signal) for detecting that the process cartridge 2 is arranged at an appropriate position (image formation position S1) in the cartridge attachment portion 111 when the push switch 190B abuts against a part of the process cartridge support board 171.

In the present embodiment, the push switch 190B detects that the process cartridge 2 is arranged at the image formation position S1 in the apparatus with an allowable range of several mm or less.

The safety switch 180 may be one which is able to detect a closed state of the front cover 150B, and, for example, the push switch manufactured by Shinden Co., Ltd. (SDP-106A-21) is usable. Note that, one equivalent to the safety switch 180 may be used as the push switch 190B.

The process cartridge 2 is, as shown in FIG. 13A, provided with a handle 20*a* on the side opposite to the insertion side to the cartridge attachment portion 111. This makes a manual operation by the user easier.

Further, in the present embodiment, as shown in FIG. 11, in the image forming apparatus 100B, the display portion 131 is configured as a notifying portion for visually notifying a user of a state of the image forming apparatus 100B as well as the speaker 132 is configured as a notifying portion for aurally notifying the user of a state of the image forming apparatus 100B.

In the present embodiment, as a configuration of the moving portion 170B, in addition to the driving gears 172 and 173, for driving them, it is configured using two driving motors, two one-way electromagnetic clutches 175, one torque limiter, and one timer, but the present invention is not limited to this configuration.

As a modification example of the present embodiment, for example, as the configuration of the moving portion, it may be configured using one driving gear, one driving motor, one torque limiter, and one timer.

Moreover, as the moving portion, a conveyance belt (for example, rubber (NBR) belt) may be used instead of the driving gear.

Next, description will be given for a main electric configuration of the image forming apparatus 100B of this second embodiment with reference to a block diagram.

FIG. 15 is a block diagram showing an electric configuration of the image forming apparatus 100B of this second embodiment.

As shown in FIG. 15, the image forming apparatus 100B is comprised of, as the electric configuration, a control portion 201B for controlling actions of the image forming apparatus 100B, the high pressure portion 202, the exposure portion 203, the transfer portion 204, the fixing portion 205, the paper feed portion 206, the feed portion 207, the paper output portion 208, the power source portion 210, the driving portion 211, the communication portion 212, the storage portion 213, the voice transmitting portion (speaker) 214, the alarm transmitting portion (speaker) 215, and the like.

In the present embodiment, the speaker 132 is configured so as to function as the voice transmitting portion 214 and the alarm transmitting portion 215.

In addition to the configuration described above, the control portion 201B is connected to each of the automatic document feeder 120, the display portion 131, the safety switch 180, the push switch 190B, the process cartridge 2, the moving portion 170B and the like, and controls the whole image forming apparatus 100B.

In addition, the control portion 201B is characterized by including a cartridge information notifying function 2011B, a cartridge moving function 2012B, and a cartridge information notification cancelling function 2013.

The cartridge information notifying function 2011B, when it becomes necessary to replace the process cartridge 2, notifies cartridge replacement indicating information (first notification information) that the process cartridge 2 needs to be replaced, by means of display and sound of the display portion 131 and the speaker 132.

The detection of replacement of the process cartridge 2 may be performed by detecting emptiness of toners with a not-shown photo sensor in the developing tank (toner container) 24.

The cartridge moving function 2012B has a first cartridge moving function and a second cartridge moving function.

The first cartridge moving function is a function for, when it is detected by the safety switch 180 that the front cover 150B is opened, moving the process cartridge 2 from the image formation position S1 (FIG. 13A) to the outside (outer side) of the image forming apparatus by the moving portion 170B.

The second cartridge moving function is a function for, when it is detected by the safety switch 180 that the front cover 150B is closed, moving the process cartridge 2 from the outside of the image forming apparatus to the image formation position S1 (FIG. 13B) by the moving portion 170B.

The cartridge information notification cancelling function 2013 has a first cartridge information notification cancelling function and a second cartridge information notification cancelling function.

The first cartridge information notification cancelling function is a function for, when it is detected by the push switch 190B that the moving portion 170B moves the process cartridge 2 from the outside of the image forming apparatus to the image formation position S1 (FIG. 13B), cancelling notification of cartridge replacement indicating information.

The second cartridge information notification cancelling function is a function for, when it is detected by the push switch 190B that the moving portion 170B moves the process cartridge 2 from the outside (outer side) of the image forming apparatus to the image formation position S1, cancelling notification of cartridge replacement indicating information after notifying cartridge appropriate position notification information (second notification information) for indicating that the process cartridge 2 is arranged at the appropriate image formation position S1, by means of display and sound of the display portion 131 and the speaker 132.

Here, description will be given for an example that cartridge replacement indicating information is displayed on the display portion 131 of the operation panel 130 in notifying processing by the cartridge information notifying function 2011B of the control portion 201B of the present embodiment.

Figure 16A:
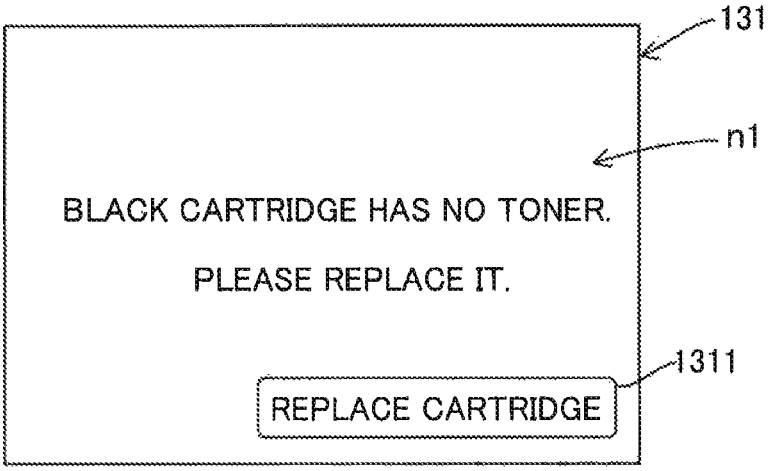
FIG. 16A is an explanatory view showing an example of first notification information of cartridge information displayed on a display portion of the image forming apparatus and FIG. 16B is an explanatory view showing an example of second notification information of cartridge information displayed on the display portion.
Figure 16B:
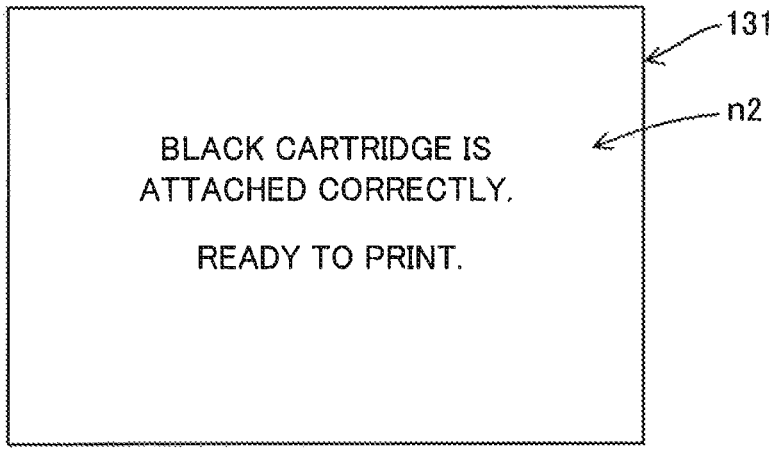

FIG. 16A is an explanatory view showing an example of cartridge replacement notification information displayed on the display portion of the image forming apparatus of the present embodiment and FIG. 16B is an explanatory view showing an example of cartridge appropriate position notification information displayed on the display portion.

In the image forming apparatus 100, when toners in the process cartridge 2, for example, for black becomes empty, as shown in FIG. 16A, a message n1 that "Black cartridge has no toner. Please replace it." is displayed as cartridge replacement indicating information on the display portion 131 of the operation portion 130.

On the display portion 131 in this case, an icon (selection area) 1311 of "replace cartridge" is displayed as cartridge replacement indicating information. Note that, the icon (selection area) 1311 as cartridge replacement indicating information may be deleted, but by providing the icon (selection area) 1311, it is possible to realize more reliable replacement of the cartridges.

Further, when replacement working of the process cartridge 2 for black is finished correctly, as shown in FIG. 16B, a message n2 that "Black cartridge is attached correctly. Ready to print." is displayed as cartridge appropriate position notification information on the display portion 131 of the operation panel 130.

Note that, here, as means for notifying the user of cartridge replacement indicating information and cartridge appropriate position notification information, notification is performed visually by displaying the messages n1 and n2 and the icon on the display portion 131, but cartridge replacement indicating information and cartridge appropriate position notification information may be notified aurally by voice guidance.

The voice guidance is transmitted from the speaker 132 as shown in FIG. 11.

The number of times of the voice guidance may be once or a plurality of times.

For example, the number of times of the voice guidance may be set by operating the operation panel 130 by the user. Moreover, the setting may be performed so as to perform the transmission during the time till when the front cover 150B is closed and the safety switch 180 is turned on again after cartridge replacement is finished.

Further, as means for notifying the user of cartridge replacement indicating information and cartridge appropriate position notification information, alarm may be enabled to be set in the same manner as the voice guidance.

Next, description will be given for processing procedure of cartridge confirmation when replacing the process cartridges 2 in the image forming apparatus 100B of this second embodiment, based on a flowchart.

Figure 17:
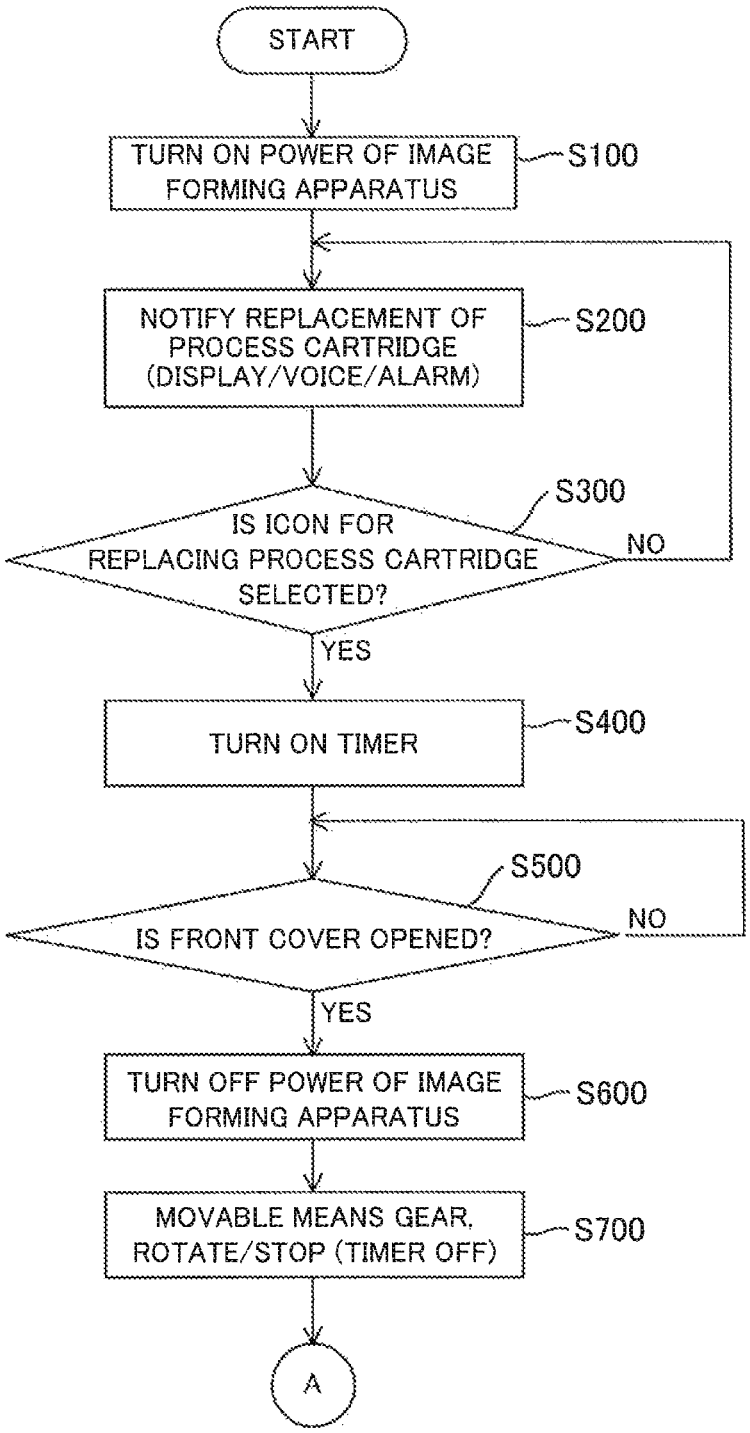
FIG. 17 is a flowchart showing a part of procedure of cartridge confirmation in the case of replacing the process cartridges in the image forming apparatus.
Figure 18:
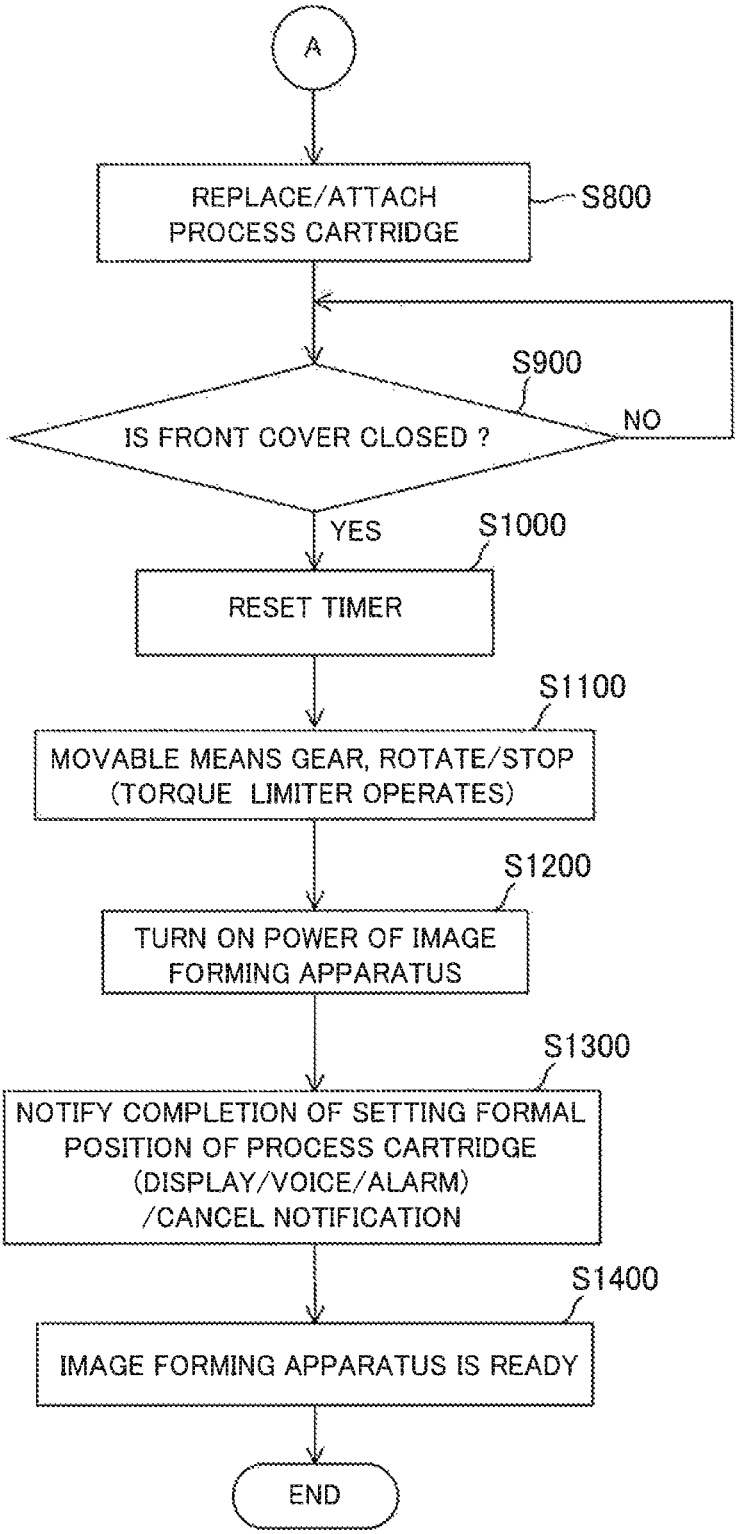
FIG. 18 is a flowchart subsequent to the flowchart of FIG. 17.

FIG. 17 is a flowchart showing a part of procedure of cartridge confirmation when replacing the process cartridges 2 in the image forming apparatus 100B of the present embodiment and FIG. 18 is a flowchart subsequent to the flowchart of FIG. 17.

In the present embodiment, when the process cartridges 2 are replaced in the image forming apparatus 100B, cartridge appropriate position notification information (second notification information) as to whether or not the target process cartridge 2 is attached appropriately, is notified.

First, in a case where power of the image forming apparatus 100B is turned on (step S100), when the process cartridge 2 needs to be replaced, cartridge replacement indicating information (first notification information) that the process cartridge 2 needs to be replaced, is notified (step S200). This first notification information is notified by display of a message on the display portion 131 and/or voice guidance or alarm with the speaker 132.

In the present embodiment, the message n1 that "Black cartridge has no toner. Please replace it." (FIG. 16A) and the icon (selection area) 1311 of "replace cartridge" are displayed as the first notification information on the display portion 131 of the operation panel 130.

Then, whether or not the icon 1311 of "replace cartridge" is selected is judged (step S300).

When the icon 1311 is not selected at step S300, the procedure returns to step S200 and notification of cartridge replacement indicating information is repeated.

On the other hand, when it is judged that the icon 1311 is selected at step S300, a timer concerning processing for moving the process cartridge 2 to be replaced is turned on (step S400), and the target process cartridge 2 is moved outside the cartridge attachment portion 111 by the moving portion 170B.

When the target process cartridge 2 is moved outside the cartridge attachment portion 111, the front cover 150B is opened in conjunction with the action of the moving portion 170B.

Then, whether or not the front cover 150B is opened is judged (step S500).

When it is judged that the front cover 150B is not opened at step S500, confirmation of opening of the front cover 150B is repeated.

On the other hand, when it is judged that the front cover 150B is opened at step S500, power of the image forming apparatus 100B is turned off (step S600), and rotation of the driving gear 172 of the moving portion 170B is stopped upon turning off of the timer (step S700).

Then, working of replacing the target process cartridge 2 is performed by the user, and the process cartridge 2 is attached in the cartridge attachment portion 111 (step S800).

Then, whether or not the front cover 150B is closed is judged (step S900).

When it is judged that the front cover 150B is not closed at step S900, confirmation of closing of the front cover 150B is repeated.

On the other hand, when it is judged that the front cover 150B is closed, the timer is reset (step S1000), and after the moving portion 170B moves the process cartridge 2 to convey to the image formation position S1 in the cartridge attachment portion iii, the torque limiter of the driving gear 173 operates, and current flow of the driving motor is stopped to stop rotation of the driving gear 173 (step S1100).

Then, power supply of the image forming apparatus 100B is turned on (step S1200), information (second notification information) that the process cartridge 2 is attached correctly is notified, and notification of the previous first notification information displayed on the display portion 131 is cancelled (step S1300). This second notification information is notified by display of a message on the display portion 131 or voice guidance and/or alarm with the speaker 132.

Here, description will be given specifically for detection of the replaced process cartridge 2.

As to which process cartridge 2 is replaced among a plurality of kinds of process cartridges 2, for example, a detection signal of a not-shown photo sensor for detecting emptiness of toners in the toner container (developer tank 24 (FIG. 12B)) of the process cartridge 2 is detected, and information identifying the push switch 190B at a position corresponding to the process cartridge 2 which has become empty is stored in the storage portion 213 (FIG. 15) of the image forming apparatus 100B.

Thereby, it is detected by the push switch 190B that the process cartridge 2 which has become empty is removed from the image forming apparatus 100B and a new process cartridge 2 is inserted in the image forming apparatus 100B, thus making it possible to confirm that the target process cartridge 2 is replaced.

Then, the image forming apparatus 100B is set to a standby state (step S1400), and the replacement processing of the process cartridges 2 in the image forming apparatus 100B is finished.

In this manner, it is possible to replace the target process cartridge 2 reliably in the image forming apparatus 100B.

As described above, the image forming apparatus 100B, to which a plurality of process cartridges are to be attached, is comprised of the cartridge attachment portion 111 to which each of the plurality of process cartridges 2 is attached to be attachably and detachably disposed, the front cover 150B for opening and closing the cartridge attachment portion 111, the moving portion 170 for moving the process cartridge 2, and the control portion 201B for controlling an action of each portion, and forms an image on recording medium (sheet P) using a recording material (toner) contained in the process cartridge 2.

The image forming apparatus 100B is further comprised of the safety switch (first detecting portion) 180 for detecting the front cover 150B; the push switches (second detecting portions) 190B for detecting presence and absence of the process cartridges 2, and the display portion 131 and the speaker 132 as a notifying portion for notifying the user of the states of the process cartridges 2.

The control portion 201B is comprised of the cartridge information notifying function 2011B that notifies the display portion 131 and the speaker 132 of the first notification information (cartridge replacement indicating information) showing that the process cartridge 2 needs to be replaced; the cartridge moving function 2012B that, when the front cover 150B is detected by the safety switch 180, moves the process cartridge 2 by using the moving portion 170B; and the cartridge information notification cancelling function 2013 that, when it is detected by the push switch 190B that the process cartridge 2 is moved by the moving portion 170B, cancels notification of the first notification information.

With the cartridge information notifying function 2011B, in the case of attaching the process cartridge 2 to the image forming apparatus 100B, the process cartridge 2 to be replaced is made clear, thus making it possible to prevent the process cartridge 2 from being replaced erroneously.

With the cartridge moving function 2012B, since the replaced process cartridge 2 is automatically guided to the appropriate image formation position S1 by the moving portion 170B, it is possible to obtain the image forming apparatus 100B capable of preventing damage of a driving gear and the like due to abnormal attachment of the process cartridge 2 to realize the stable attaching and detaching operability of the process cartridge 2 over a long period of time.

Further, included as the cartridge information notification cancelling function 2013 are a function (first cartridge information notification cancelling function) for cancelling notification of the first notification information when it is detected by the push switch 190B that the moving portion 170B moves the process cartridge 2 from the outside of the image forming apparatus to the image formation position, and a function (second cartridge information notification cancelling function) for, when it is detected by the push switch 190B that the moving portion 170B moves the process cartridge 2 from the outside (outer side) of the image forming apparatus to the image formation position, cancelling notification of the first notification information after the second notification information for informing that the process cartridge 2 is arranged at the appropriate image formation position S1 is notified with display and sound by the display portion 131 and the speaker 132. Therefore, the user is able to grasp that the replaced process cartridge 2 is set to the image forming apparatus 100B normally and to use the image forming apparatus 100B at ease.

Further, according to this second embodiment, by displaying the icon (selection area) 1311 which is selectable by the user as the first notification information to be displayed on the display portion 131, the user is able to easily grasp necessity of replacement of the process cartridge 2.

Further, according to this second embodiment, by including the torque limiter (movement suppressing means) as the configuration of the moving portion 170B, it is possible to suppress the process cartridge 2 to be pressed inner side than the image formation position S1 more than necessary and prevent breakage of a driving gear of the process cartridge 2 and the like.

Further, according to this second embodiment, since the configuration of the process cartridge 2 is set as the unit configuration provided with the photosensitive member drum 3, the cleaner unit 4, the charging roller 5, and the developing device 20, when a plurality of process cartridges 2 are provided as the image forming portion, it is possible to configure the image forming portion compactly and to obtain the image forming apparatus with a saved space.

Further, according to this second embodiment, as the configuration of the moving portion 170B, the groove 174 of the process cartridge support board 171 for supporting the process cartridge 2 and the driving gears 172 and 173 are caused to abut for moving to a predetermined position, so that it is possible to move the process cartridge 2 without abutting against the process cartridge 2 directly, thus making it possible to prevent a main body of the cartridge from being deformed, warped and damaged without the process cartridge 2 being directly imposed loads from moving means (driving gears 172 and 173). Accordingly, it is possible to move the process cartridge 2 to the image formation position S1 naturally and to reuse a main body of the cartridge.

Further, according to this second embodiment, as the configuration of the image forming apparatus 100B, it is configured such that the plurality of process cartridges 2 are provided and the plurality of process cartridges 2 are arranged, in parallel, in the oblique direction with respect to the horizontal direction of the image forming apparatus 100B, thus making it possible to realize the image forming apparatus 100B with a saved space by suppressing a size in a width direction of the image forming apparatus 100B.

Further, according to this second embodiment, by providing the display portion 131 and the speaker (voice transmitting portion, alarm transmitting portion) 132 so as to function as notification means, for example, even if the user is a visually weak person, it is possible to transmit notification contents reliably.

Note that, the present invention is not limited to the first and second embodiments described above, and various changes are allowed in the scope shown in the claims. That is, embodiments that are obtained in combination with technical means changed as appropriate in the scope without departing from the spirit and scope of the present invention are also included in a technical scope of the present invention.

What is claimed is:

1. An image forming apparatus for forming an image on a recording medium by using toner contained in a cartridge, comprising:

a plurality of cartridges, each of which contains toner;

an attachment portion configured to contain the plurality of cartridges, each cartridge being disposed attachably and detachably;

an opening and closing member, provided so as to be rotatable with respect to an apparatus main body, configured to open and close the attachment portion;

a moving portion configured to move the cartridge to an image formation position in conjunction with an action of closing the opening and closing member;

a control portion;

a first detecting portion configured to detect the opening and closing member;

a second detecting portion configured to detect presence and absence of the cartridge; and a notifying portion configured to notify a user that the cartridge is not attached appropriately, wherein the control portion is provided with a function of, when it is detected by the first detecting portion that the opening and closing member is closed and the cartridge is not detected by the second detecting portion, notifying the notifying portion of information of the cartridge, the control portion is provided with a function of, when it is detected by the first detecting portion that the opening and closing member is closed and the cartridge is not detected by the second detecting portion, not allowing driving of the image forming apparatus, the first detecting portion includes a safety switch of the image forming apparatus, the second detecting portion includes a detector configured to detect a position of the cartridge, and the notifying portion is a speaker configured to notify the user that the cartridge is not attached appropriately with sound.

2. The image forming apparatus according to claim 1, wherein the control portion is provided with a function of, when it is detected by the first detecting portion that the opening and closing member is closed and the cartridge is detected by the second detecting portion, allowing driving of the image forming apparatus.

3. The image forming apparatus according to claim 1, wherein the cartridge includes at least any one of a toner container, a photosensitive member, a charging device, and a developing device.

4. An image forming apparatus for forming an image on a recording medium by using toner contained in a cartridge, comprising:

a plurality of cartridges, each of which contains toner;

an attachment portion configured to contain the plurality of cartridges, each cartridge being disposed attachably and detachably;

an opening and closing member configured to open and close the attachment portion;

a moving portion configured to move the cartridge;

a control portion;

a first detecting portion configured to detect the opening and closing member;

a second detecting portion configured to detect presence and absence of the cartridge; and a notifying portion configured to notify a user that the cartridge needs to be replaced, wherein the control portion is provided with a function of notifying the notifying portion of first notification information showing necessity of replacing the cartridge, a function of, when it is detected by the first detecting portion that the opening and closing member is opened, moving the cartridge from an image formation position to an outside of the image forming apparatus by the moving portion, a function of, when it is detected by the first detecting portion that the opening and closing member is closed, moving the cartridge from the outside of the image forming apparatus to the image formation position by the moving portion, and a function of, when it is detected by the second detecting portion that the moving portion moves the cartridge from the outside of the image forming apparatus to the image formation position, cancelling notification of the first notification information, wherein the first detecting portion includes a safety switch of the image forming apparatus, the second detecting portion includes a detector configured to detect a position of the cartridge, and the notifying portion is a speaker configured to notify the user that the cartridge needs to be replaced with sound.

5. The image forming apparatus according to claim 4, wherein the control portion is provided with a function of, when it is detected by the second detecting portion that the moving portion moves the cartridge from the outside of the image forming apparatus to the image formation position, notifying the notifying portion of a second notification information for informing that the cartridge is arranged at an appropriate image formation position, and thereafter cancelling notification of the first notification information.

6. The image forming apparatus according to claim 4, wherein the notifying portion includes a display configured to visually notify the user of the state of the cartridge, and the first notification information is the sound from the speaker and visual information displayed on the display.

7. The image forming apparatus according to claim 5, wherein the notifying portion includes a display configured to visually notify the user of the state of the cartridge, and the first notification information is the sound from the speaker and visual information displayed on the display.

8. The image forming apparatus according to claim 4, wherein the moving portion is provided with a movement suppressing portion.

9. The image forming apparatus according to claim 4, wherein the cartridge includes at least any one of a toner container, a photosensitive member, a charging device, and a developing device.

* * * * *